US006084559A

United States Patent [19]

Nagao et al.

[11] Patent Number: 6,084,559

[45] Date of Patent: Jul. 4, 2000

[54] PLASMA-DISPLAY PANEL OF HIGH LUMINOSITY AND HIGH EFFICIENCY, AND A DRIVING METHOD OF SUCH A PLASMA-DISPLAY PANEL

[75] Inventors: Nobuaki Nagao, Uji; Junichi Hibino, Neyagawa; Yusuke Takada, Katano, all of Japan

[73] Assignee: Matsushita Electric Industrial Co., Ltd., Osaka-fu, Japan

[21] Appl. No.: 08/802,539

[22] Filed: Feb. 18, 1997

[30] Foreign Application Priority Data

| | | | |
|---|---|---|---|
| Feb. 15, 1996 | [JP] | Japan | 8-027533 |
| May 14, 1996 | [JP] | Japan | 8-118725 |

[51] Int. Cl.[7] ..... G09G 3/28

[52] U.S. Cl. ..... 345/67; 345/71

[58] Field of Search ..... 345/60, 67, 66, 345/65, 71, 68, 72, 56, 62, 70; 313/585, 582, 484, 587, 584; 315/169.3, 169.1, 166

[56] References Cited

U.S. PATENT DOCUMENTS

| | | | |
|---|---|---|---|
| 3,778,674 | 12/1973 | Lustig | 345/60 |
| 3,840,779 | 10/1974 | Schermerhorn | 345/68 |
| 3,876,906 | 4/1975 | Walters | 345/63 |
| 3,973,253 | 8/1976 | Criscimagna | 345/70 |
| 4,162,427 | 7/1979 | Kamegaya et al. | 345/60 |
| 4,320,418 | 3/1982 | Pavliscak | 345/60 |
| 4,728,864 | 3/1988 | Dick | 345/67 |
| 4,783,651 | 11/1988 | Fischer et al. | 345/71 |
| 5,306,984 | 4/1994 | Lee | 313/484 |
| 5,661,500 | 8/1997 | Shinoda et al. | 345/60 |
| 5,744,909 | 4/1998 | Amano | 345/60 |

FOREIGN PATENT DOCUMENTS

| | | |
|---|---|---|
| 0680067 | of 0000 | European Pat. Off. . |
| 6176699 | of 0000 | Japan . |
| 7037513 | of 0000 | Japan . |
| 7064507 | of 0000 | Japan . |
| 8190870 | of 0000 | Japan . |
| 2105102 | of 0000 | United Kingdom . |

*Primary Examiner*—Jeffery Brier
*Attorney, Agent, or Firm*—Price, Gess & Ubell

[57] ABSTRACT

A plasma-display panel of high luminosity and efficiency which does not require auxiliary cells so that the panel structure has high-density cells, enabling longer emission time and smaller reactive power. A driving method of such a PDP comprising a first insulator substrate and a second insulator substrate which is arranged at a given distance above the first insulator substance; the first insulator substrate having a first line electrode group and a second line electrode group which are parallel, and the second insulator substrate having a third line electrode group which are parallel to the first and the second line electrode groups so that the third line electrode group and the first and the second electrode groups appear to form a two-dimensional lattice when viewed from above; thereby forming a discharge space between the first and the second insulator substrates; the first and the third line electrode groups having parts exposed to the discharge space, while the second line electrode group being covered by dielectric layer in the discharge space. The method comprises: writing image information by addressing discharge between the line electrode groups which appear to form a two-dimensional lattice when viewed from above and accumulating charges on the dielectric layer; and floating the charges in the discharge space by applying an auxiliary pulse voltage below discharge voltage to the second electrode group, and generating direct current discharge by applying a sustain pulse voltage in-between the first and the third line electrode groups.

26 Claims, 17 Drawing Sheets

Fig. 1 PRIOR ART

Fig. 2 PRIOR ART

Fig. 4 PRIOR ART
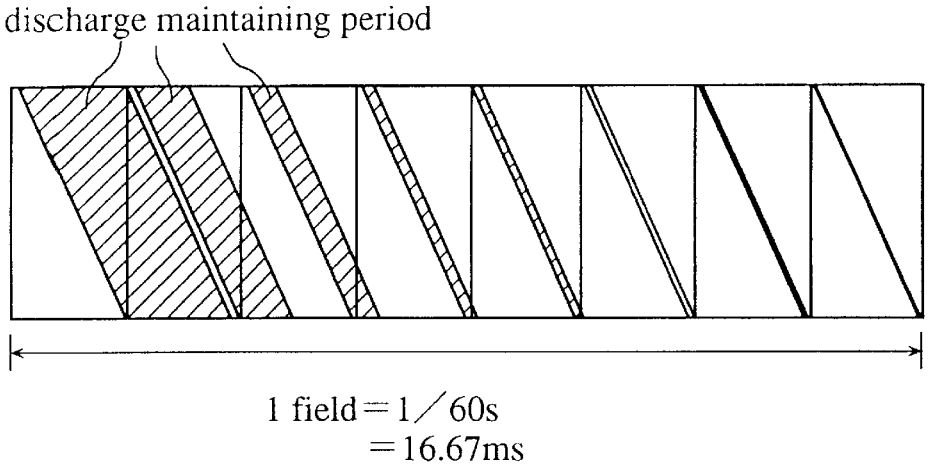
Fig. 5
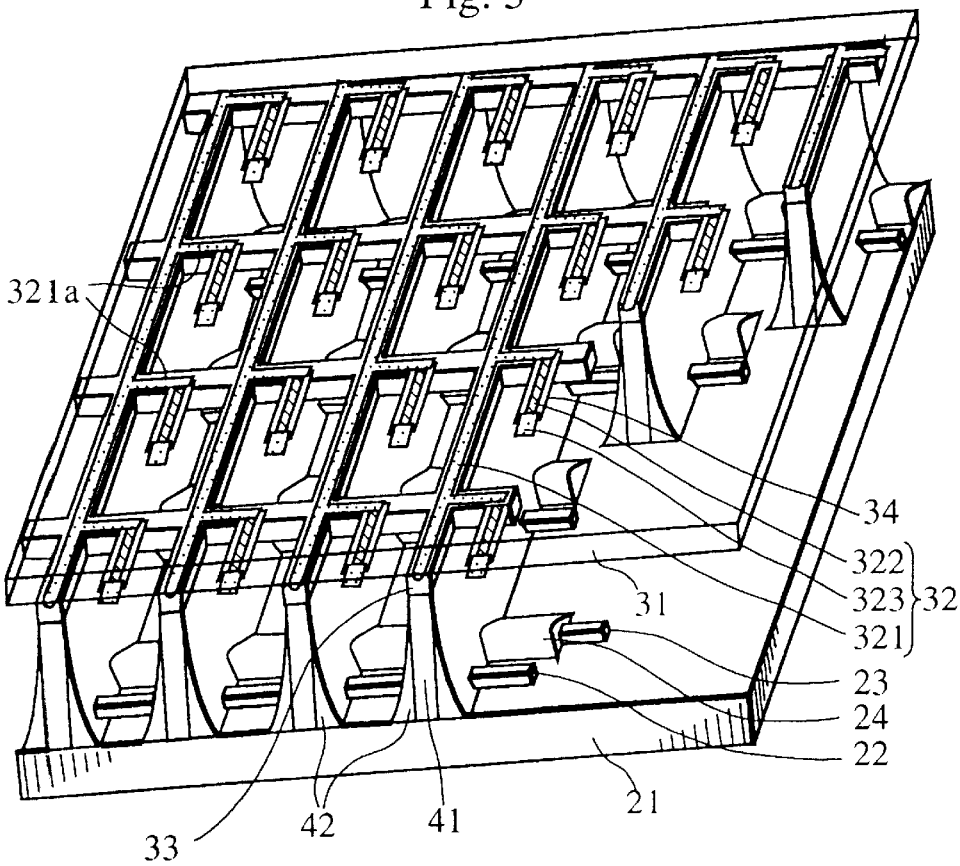

1 field = 1/72s
= 13.89ms

PLASMA-DISPLAY PANEL OF HIGH LUMINOSITY AND HIGH EFFICIENCY, AND A DRIVING METHOD OF SUCH A PLASMA-DISPLAY PANEL

BACKGROUND OF THE INVENTION (1) Field of the Invention

The present invention relates to a plasma-display panel used for a computer and a TV, and a driving method of such a plasma-display panel.

(2) Related Art

In recent years, upsizing and higher definition of display devices used for computers and TVs are in high demand. Hopes run high that plasma-display panels (PDP) will come up to such expectations for their thinness and lightness.

There are two types of PDPs: DC-PDPs and AC-PDPs.

FIG. 1 shows a schematic representation of a conventional DC-PDP. On the upper surface of glass plate 11 used as a back plate, anode line electrode group 12*a* and auxiliary line electrode group 12*b* are arranged in parallel. Thick film resistance 13, which is a discharge electrode limiting element, branches from each line electrode. Insulator layer 14 is deposited over anode line electrode group 12*a*, auxiliary line electrode group 12*b*, and thick film resistance 13. Insulator layer 14 has through holes. The interior surface of each through hole is placed with electrode pad 15 connected to a terminal of each thick film resistance 13.

On the surface of insulator layer 14, partitions 16 are arranged so as to form discharge cells 20 and auxiliary cells 20*a*. In each discharge cell 20, a phosphor layer 19 is arranged on the side and the bottom.

On the lower surface of glass plate 18 used as a front plate, cathode line electrode group 17 is arranged.

Anode line electrode group 12*a* and electrode pad 15 are exposed in discharge cell 20, and auxiliary line electrode group 12*b* is exposed in auxiliary cell 20*a*.

FIG. 2 shows a matrix layout circuit of the DC-PDP.

Horizontally, reset cathode line R is set as the first line, followed by cathode line electrodes $K_1$–$K_N$. Vertically, anode line electrodes $A_1$–$A_M$, and auxiliary line electrodes $H_1$–$H_L$ are set.

FIG. 3 is a time chart which shows timing of applying pulses to each electrode. This chart relates to a pulse memory method which has been conventionally used for the DC-PDPs. First, addressing is carried out: while scanning cathode line electrodes $K_1$–$K_N$, electrical charges are generated by pulse discharge in the discharge cell (display cell) which should be lit up. After that, the discharge is sustained. However, as the electrical charges remain only for a short period of time, they cannot store a screen of image information. In order to cope with this problem, the following method is used.

First, in scanning period $t_1$, several pulses of opposite phase are simultaneously applied to auxiliary anode group $H_1$–$H_L$ and reset cathode line R, thereby generating a stable reset discharge.

Next, in scanning period $t_3$ in which the charged particles generated by the reset discharge remain, by applying a pulse to the auxiliary line electrode group $H_1$–$H_L$ and the first cathode line electrode $K_1$, and a write pulse to the electrodes corresponding to the display cell in anode line electrode group $A_1$–$A_M$, stable auxiliary discharge occurs between auxiliary line electrode group $H_1$–$H_L$ and cathode line electrode $K_1$. This is ignited by the remaining charged particles. Moreover, being ignited by the auxiliary discharge, stable main discharge occurs between cathode line electrode $K_1$ and electrodes corresponding to the display cell in anode electrode group $A_1$–$A_M$.

The main discharge in the display cell is sustained by: generating a main discharge in the display cell by applying a sustain pulse to cathode line electrode $K_1$ in scanning period $t_6$, in which much of the charged particles generated by the main discharge in scanning period $t_3$ remain; and by doing the same in scanning periods $t_8$, $t_{10}$, . . .

Next, in scanning period $t_5$, in which the charged particles generated by the auxiliary discharge in scanning period $t_3$ remain and a sustain pulse is not applied, by applying a pulse to auxiliary line electrode group $H_1$–$H_L$ and the second cathode line electrode $K_2$, and a write pulse to electrodes corresponding to the display cell in anode line electrode group $A_1$–$A_M$, stable auxiliary discharge takes place between auxiliary line electrode group $H_1$–$H_L$ and cathode line electrode $K_2$. This is ignited by the remaining charged particles. Being ignited by the auxiliary discharge, stable main discharge occurs between cathode line electrode $K_2$ and electrodes corresponding to the display cell in the group of anode line electrodes $A_1$–$A_M$.

The main discharge in the display cell is sustained by: generating the main discharge by applying a sustain pulse to cathode line electrode $K_2$ in scanning period $t_8$, in which much of the charged particles generated by the main discharge in scanning period $t_5$ remain; and by doing the same in scanning periods $t_{10}$, $t_{12}$, . . .

The above mentioned auxiliary discharge and the main discharge is carried out in the same way with regard to cathode line electrode $K_3$, . . . $K_N$ in scanning periods $t_7$ . . . , thus forming a screen of image.

How to display TV images in the pulse memory method of the DC-PDP-mentioned above can be explained as follows.

In NTSC system, a TV image is composed of 60 fields per second. PDPs can only show two-level graduation by "ON" and "OFF". Tones in-between are displayed as follows. For red (R), green (G), and blue (B), respectively, one field is divided into several sub-fields and "ON" time is timeshared. Tones in-between "ON" and "OFF" are displayed by the combination of the sub-fields. This method is called "field timesharing graduation display method".

FIG. 4 is a graph showing the field dividing method for 256 gray scales. The horizontal axis shows time and the vertical axis shows order of the scanning lines (scans from top to bottom), the slashed part represents discharge sustaining periods.

One field consists of eight sub-fields, each having an equal cycle. Write scanning is carried out in the cycle which is equal to a sub-field cycle. In each scanning line, discharge sustaining operation is carried out subsequent to the write scanning.

The ratio of the discharge sustaining period of each sub-field is set as 1, ½, ¼, ⅛, 1/16, 1/32, 1/64, and 1/128. By the combination of the eight bit binary, 256 gray scales can be displayed.

As is apparent from FIG. 4, the ratio of the discharge sustaining period in one field is only about ¼. Moreover, as the sustain pulses are applied on and off, the ratio of the discharge sustaining period that really contributes to the emission is even smaller than the above mentioned ratio.

For example, when a cycle of the sustain pulse is 4 (μsec), duty ratio of the sustain pulse is ½ of the theoretical maximum value, and the number of the sustain pulse applied to the shortest discharge sustaining period (1/128) is 3, the number of pulses per field (P) can be expressed as $P=(2^8-1)*3=765$. The real discharge sustaining period in one field cycle (1/60 sec=16.67 msec) becomes 4*½*765(μsec)=1.53 (msec). In this case, the discharge sustaining period which really contributes to the emission is less than 10% of a field cycle.

As mentioned above, as the conventional DC-PDPs have practically short discharge sustaining period, the maximum luminance can be around 150 cd/m$^2$.

In the driving method mentioned above, as the addressing discharge is carried out in the short period of time between the sustain pulses, rise time of the addressing discharge pulse has to be short. For that reason, main discharge and sustaining of the discharge are caused by the effect of the residual charged particles generated by the auxiliary discharge of the preceding scanning line in each scanning line.

In such a case, if three discharge cells of red (R), green (G), and blue (B) are arranged on a scanning line, the dot size of one pixel becomes rather large. Therefore, good image quality for computers and TVs cannot be obtained. In order to cope with this problem, two scanning lines are used for one pixel as shown in FIG. 1. In FIG. 1, a red cell and a green cell are arranged on the upper line, and a green cell and a blue cell are arranged on the lower line. Even so, the real horizontal resolution is low and "white" cannot be displayed by one scanning line, which is not suitable for computer displays as they require high-definition image quality.

Also, when driving the DC-PDPs by the pulse memory method, as charging and discharging are repeated by applying pulses of several hundred volts to the capacitative load between the electrodes, electricity that does not directly contribute to the emission is consumed in a large amount. It is highly demanded that such reactive power should be reduced for energy saving.

In the case of conventional AC-PDPs, electrodes covered with dielectric layers are arranged. By accumulating the electric charges caused by the addressing discharge on the dielectric layer as wall charges, a screen of image information can be stored. Therefore, it is possible to apply the sustain pulse to all the scanning lines at a dash when the discharge is sustained. Therefore, the ratio of the discharge sustaining period in one field can be increased compared to the DC-PDP, but as the applied sustain pulse is AC, the emission in the discharge sustaining period is on and off. The real discharge sustaining period that contributes to the emission is up to 20–30% of one field cycle.

Also, the AC-PDPs have larger capacity (Cp) between electrodes compared to the DC-PDPs. Therefore, the amount of reactive power is large.

For example, in the case of a 21-type color monitor panel having 640(*3)pixels*480pixels, the entire capacity Cp could reach 17 nF.

When 17 nF is Cp, 180V is sustaining voltage $V_S$, and 200 $kH_Z$ is frequency f, electricity Wc for driving in the discharge sustaining period is 2(charging/discharging)*2 (inversion)*½*17 nF*(180V)$^2$*200 $kH_Z$=220 W.

Japanese Laid-open Patent Application No. 63-101897 discloses a method of suppressing the reactive power. It is to recover the reactive power by using inductance between the switching element in the driving circuit and the capacitative load and using the principle of the LC serial resonance circuit.

However, as can be understood from the fact that the condition of the plasma and the conduction rate differs greatly depending on the condition whether all the dots are lit up, or whether they are put out, capacitative load of the PDP applied to the driving circuit in the discharge sustaining period differs greatly when displaying motion pictures on TVs. Therefore, if the time constant of the serial resonance circuit of the driving circuit is constant, reactive power cannot be reduced so much.

Here, it possible to dynamically change the time constant depending on the discharge current of the panel in the discharge sustaining period. However, in that case, construction of the driving circuit becomes complicated and the cost increases greatly.

SUMMARY OF THE INVENTION

It is an object of the present invention to provide a plasma-display panel of high luminosity and high efficiency which does not require auxiliary cells so that the panel structure has high-density cells and a driving method of such a plasma-display panel. The object can be achieved by the following features.

(1) A driving method of a plasma-display panel comprising a first insulator substrate and a second insulator substrate which is arranged at a given distance above the first insulator substance; the first insulator substrate having a first line electrode group and a second line electrode group, with the electrodes being arranged in parallel in each group, and the second insulator substrate having a third line electrode group which has parallel electrodes passing over at least one of the first line electrode group and the second line electrode group at right angles so that the third line electrode group and the selected line electrode group on the first insulator substrate appear to form a two-dimensional lattice when viewed from above; thereby forming a discharge space between the first insulator substrate and the second insulator substrate; the first line electrode group and the third line electrode group having parts exposed to the discharge space, while the second line electrode group being covered by dielectric layer in the discharge space; the method comprising the steps of:

addressing for writing image information by addressing discharge between the line electrode groups which appear to form a two-dimensional lattice when viewed from above and accumulating charges on the dielectric layer; and discharge sustaining for detaching the charges from the dielectric layer so as to float them in the discharge space by applying an auxiliary pulse voltage below discharge voltage to the second electrode group, and generating direct current discharge by applying a sustain pulse voltage in-between the first line electrode group and the third line electrode group.

(2) A driving method of a plasma-display panel comprising a first insulator substrate and a second insulator substrate which is arranged at a given distance above the first insulator substrate; the first insulator substance having a first line electrode group and a second line electrode group, with the electrodes being arranged in parallel in each group, and the second insulator substrate having a third line electrode group which has parallel electrodes passing over the first line electrode group at right angles so that the third line electrode group and the first line electrode group appear to form a two-dimensional lattice when viewed from above; thereby forming a discharge space between the first insulator substrate and the second insulator substrate; the first line electrode group and the third line electrode group having parts exposed to the discharge space, while the second line electrode group being covered by a dielectric layer in the discharge space; the method comprising the steps of:

addressing for writing image information by addressing discharge between the first electrode group and the third line electrode group and accumulating charges on the dielectric layer by applying a voltage below a discharge voltage to the second line electrode group; and discharge sustaining for detaching the charges from the dielectric layer so as to float them in the discharge space by applying an auxiliary pulse voltage to the second electrode group, and generating direct current discharge by applying a sustain pulse voltage in-between the first line electrode group and the third line electrode group.

According to the driving method mentioned above, a screen of information can be stored by a panel.

Therefore, the auxiliary pulse voltage to the second electrode group in the discharge sustaining step and the pulse voltage in-between the first electrode group and the third electrode group can be applied to the panel at a dash.

In this way, the panel does not require the auxiliary cells, thereby producing a panel structure having high-density cells. As the discharge sustaining is carried out on and off, a panel of high luminosity and high efficiency can be produced.

According to the first feature, it is possible to float the charges by a small amount of electricity.

According to the second feature, it is possible to carry out the addressing discharge by a small amount of electricity.

(3) A plasma-display panel comprising a first insulator substrate and a second insulator substrate which is arranged at a given distance above the first insulator substance; the first insulator substrate having a first line electrode group and a second line electrode group, with the electrodes being arranged in parallel in each group, the second insulator substrate having a third line electrode group which has parallel electrodes passing over the first line electrode group at right angels so that the third electrode group and the first electrode group appear to form a two-dimensional lattice when viewed from above; thereby forming a discharge space between the first insulator substrate and the second insulator substrate; the first line electrode group and the third line electrode group having parts exposed to the discharge space, while the second line electrode group being covered by the dielectric layer in the discharge space;

wherein the first line electrode group has resistance between bus bar and part exposed to the discharge space.

(4) A plasma-display panel comprising a first insulator substrate and a second insulator substrate which is arranged at a given distance above the first insulator substance; the first insulator substrate having a first line electrode group and a second line electrode group, with the electrodes in each group being arranged perpendicular to each other, the second insulator substrate having a third line electrode group passing over the first line electrode group in parallel; thereby forming a discharge space between the first insulator substrate and the second insulator substrate; the first line electrode group and the third line electrode group having parts exposed to the discharge space, while the second line electrode group being covered by the dielectric layer in the discharge space.

According to the third and the fourth features, it is possible to produce a panel structure having high-density cells because the auxiliary cells are not required. And, as the discharge sustaining is carried out on and off, a panel of high luminosity and high efficiency can be produced.

According to the third feature, as there is no need to arrange the resistance in the third electrode group, electricity consumption in the resistance does not occur during addressing discharge.

According to the fourth feature, discharge sustaining can be started by each scanning line, while wall charges are accumulated in the discharge cell by the scanning of addressing discharge between the third electrode group and the second electrode group. Therefore, it is possible to make the discharge sustaining period long.

BRIEF DESCRIPTION OF THE DRAWINGS

These and other objects, advantages and features of the invention will become apparent form the following description thereof taken in conjunction with the accompanying drawings which illustrate a specific embodiment of the invention. In the drawings:

FIG. 4 is a graph showing the field dividing method for 256 gray scales by the conventional DC-PDP;

FIG. 5 is a perspective side view of the panel structure of the PDP of the first embodiment;

Figure 1:
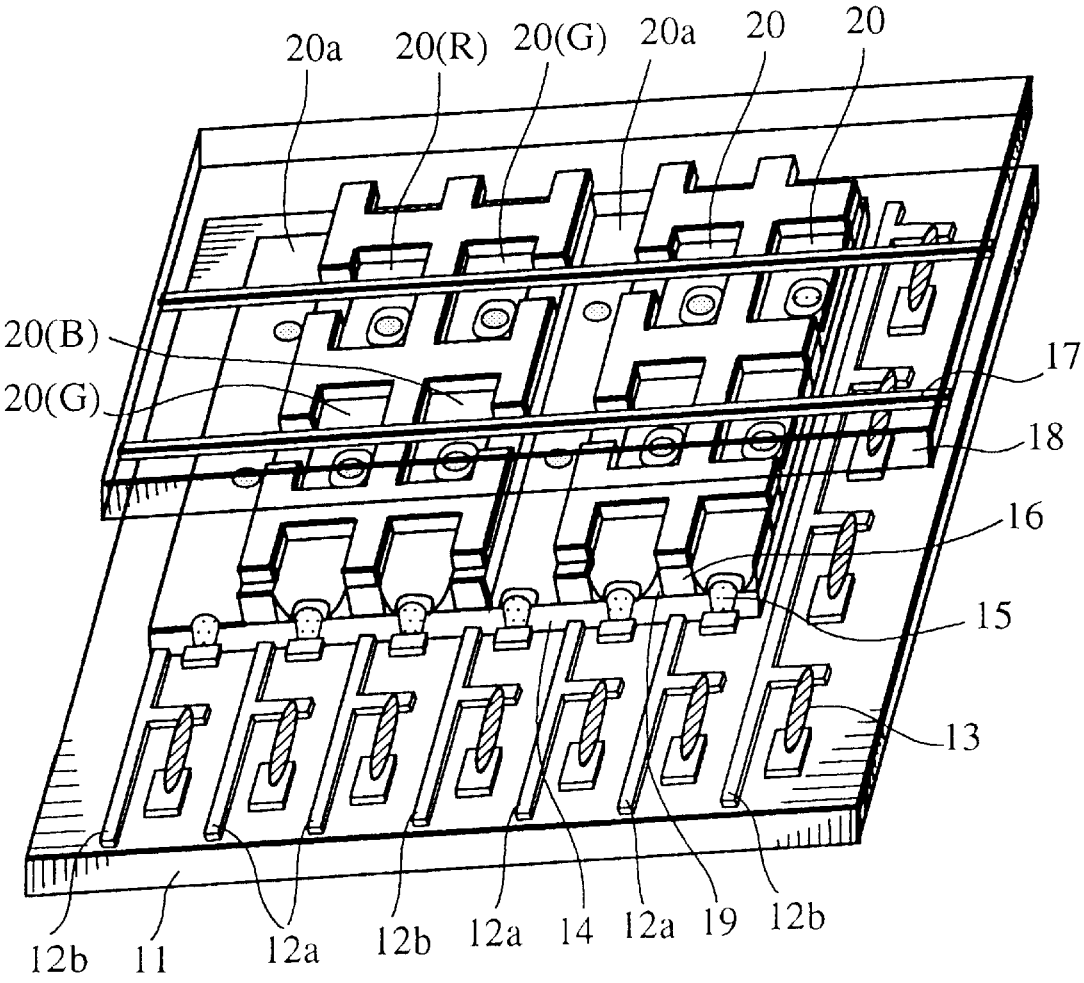
FIG. 1 shows a schematic representation of a conventional DC-PDP.
Figure 2:
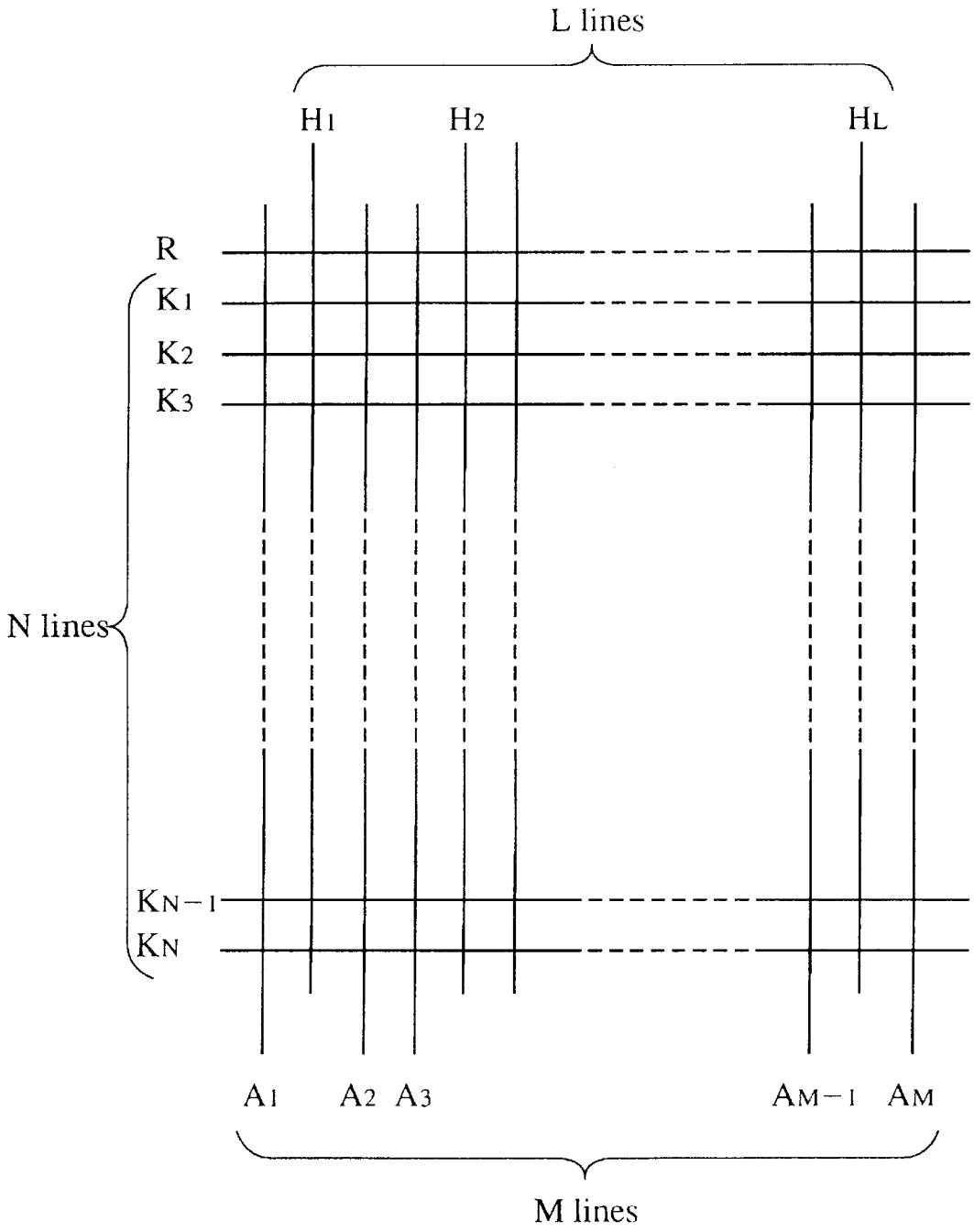
FIG. 2 shows a matrix layout circuit of the DC-PDP.
Figure 3:
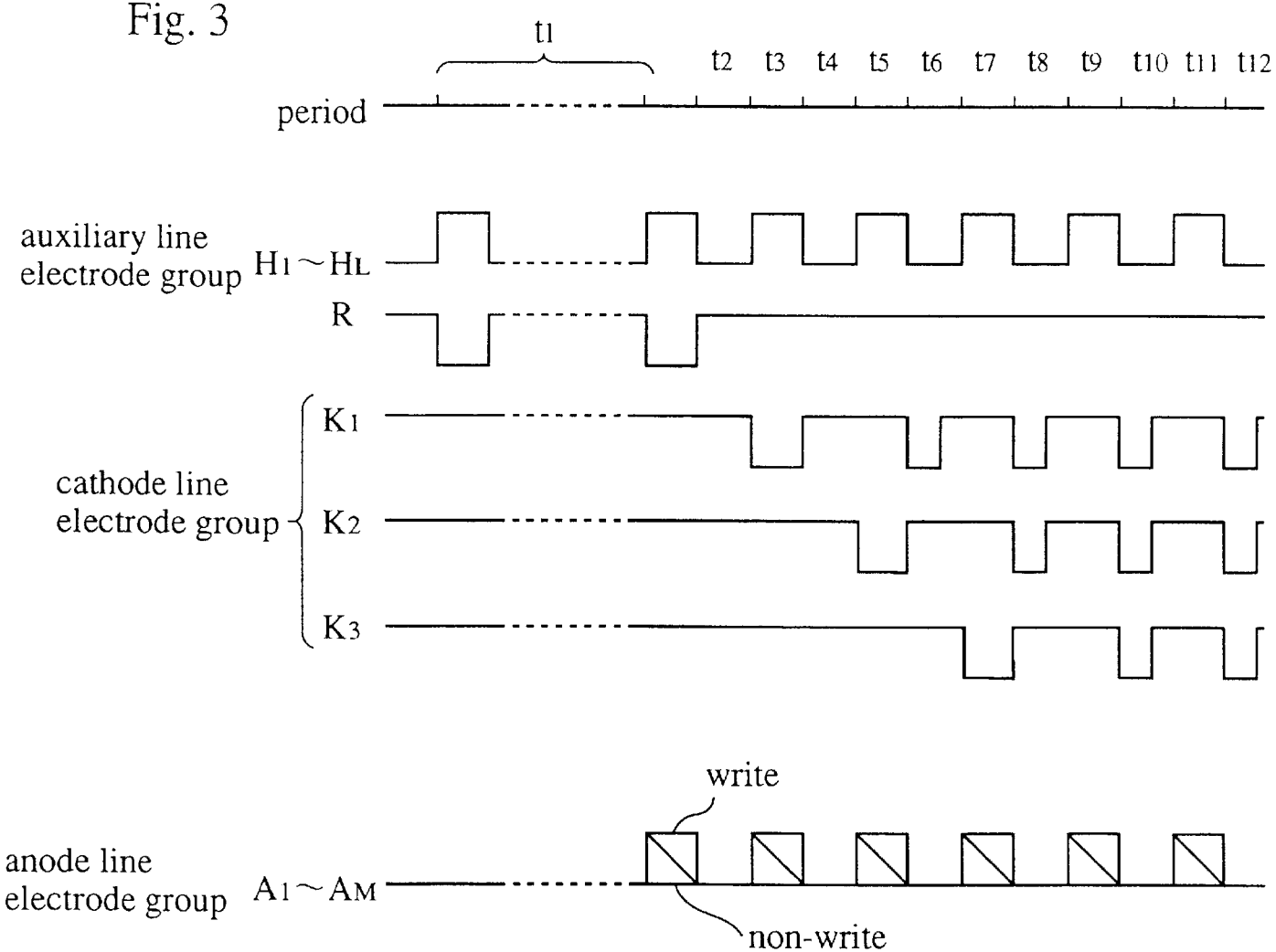
Fig. 3 PRIOR ART
FIG. 3 is a time chart which shows timing of applying pulses to each electrode.

DESCRIPTION OF THE PREFERRED EMBODIMENTS (Embodiment 1)

Panel Construction and Production Method of PDP

FIG. 5 is a perspective side view of the panel structure of the PDP of the present embodiment.

Glass substrate 21 used as a back place and glass substrate 31 used as a front plate are arranged in parallel, connected via parallel partitions 41.

On the internal surface of glass substrate 21, all the electrodes in first line electrode group 22 and second line electrode group 23 are arranged in parallel, and each line electrode in second line electrode group 23 is covered with dielectric layer 24.

Partitions 41 are perpendicular to first line electrode groups 22 and second line electrode 23 on glass substrate 21. Discharge spaces formed by glass substrates 21 and 31, and partitions 41 are filled with discharge gas (mixture of helium and xenon).

Phosphor layer 42 is arranged on partitions 41 and glass substrate 21. However, first line electrode group 22 is not completely covered by phosphor layer 42. The middle of the electrodes in this group is exposed to the discharge space.

As phosphor layer 42, red phosphor (R), green phosphor (G), and blue phosphor (B) are used alternatively.

On the internal surface of glass substrate 31, third line electrode group 32 is arranged in a way that it passes over the first line electrode group 22 and second line electrode group 23 at right angles, so that the electrodes on glass substrate 21 and electrodes on glass substrate 31 appear to form a two-dimensional lattice when viewed from above.

Third line electrode group 32 is composed of bus bars 321, resistance 322, and electrode pads 323: bus bars 321 are formed along partitions 41, and branches 321 a are perpendicular to bus bars 321; resistance 322 is connected to the tip of branches 321*a*, and electrode pads 323 are connected to the tip of resistance 322.

Moreover, on the internal surface of glass substrate 31, black matrix 33 is arranged in the form of a lattice which covers bus bars 321. Resistance 322 is covered with dielectric layer 34. As a result, bus bars 321 and resistance 322 are insulated from the discharge space, but electrode pads 323 are exposed to the discharge space.

In each discharge cell separated by black matrix 33, first electrode group 22, second electrode group 23, and electrode pad 323 exist.

Figure 6:
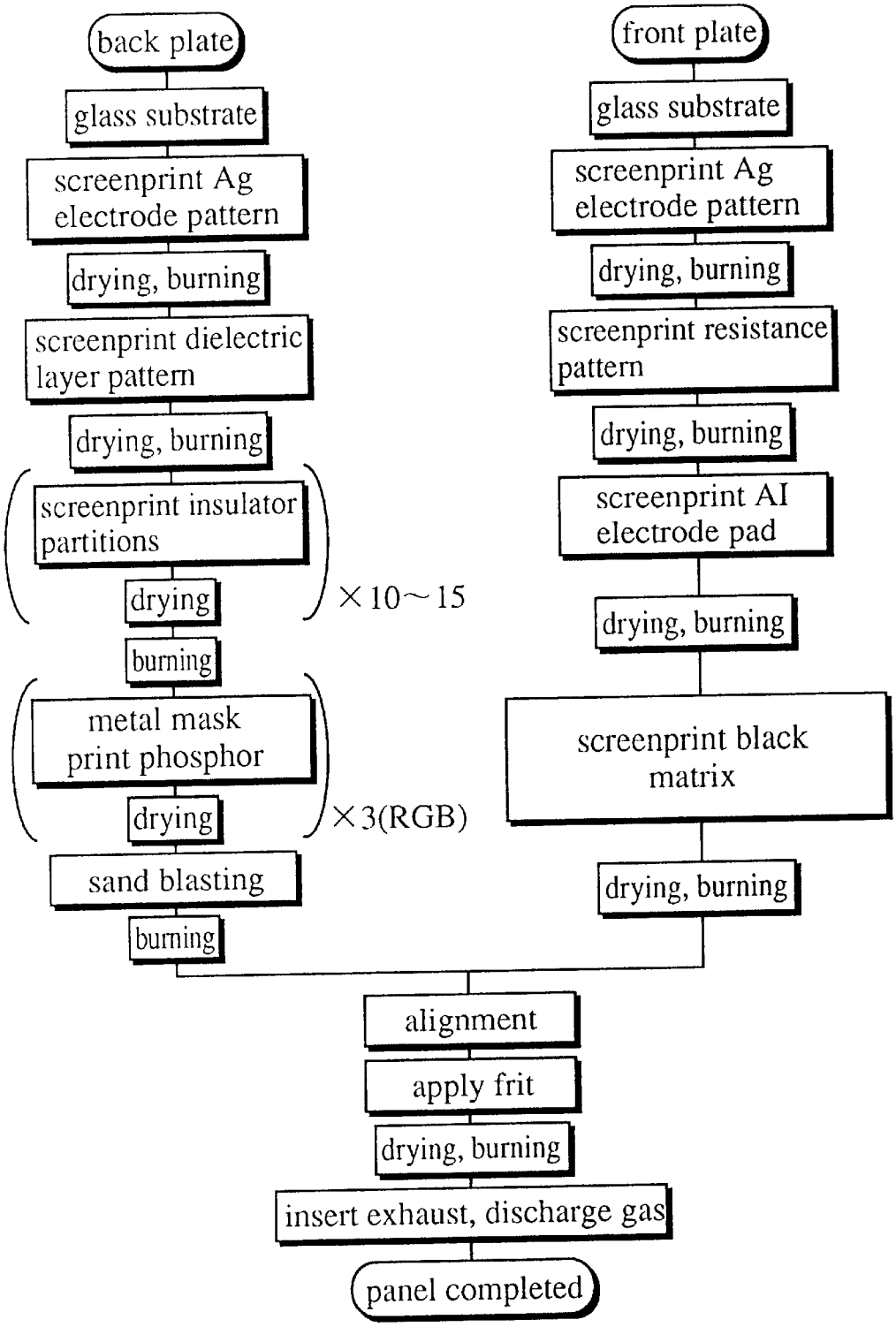
FIG. 6 shows the process of manufacturing the above mentioned PDP.

The process of forming the PDP mentioned above can be explained as follows by means of FIG. 6.

An electrode pattern is formed by screenprinting silver thick film paste on glass substrate 21. After drying and burning, first line electrode group 22 and second line electrode group 23 are formed.

Dielectric paste of low-melting point lead glass is screenprinted on second line electrode group 23. After drying and burning, dielectric layer 24 is formed.

After that, thick paste of low-melting point glass is screenprinted and dried, alternatively. When about ten layers of the thick paste are overlapped, by burning, partition 41 is formed.

Red phosphor paste (R), green phosphor paste (G), and blue phosphor paste (B) are applied to the side of partition 41 and the surface of glass substrate 21 with metal mask, and they are dried. After that, sandblasting is applied, so that the section view of the phosphor layer appears to form a bowl, exposing first line electrode group 22 in the middle discharge space.

Silver thick paste is screenprinted on glass substrate 31. After drying and burning, bus bars 321 and lower part of electrode pads 323 in third line electrode group 32 are formed.

Thick film resistance paste whose main ingredients are ruthenium oxide and glass frit is screenprinted thereon. After drying and burning, resistance 322 is formed.

Next, thick film paste of aluminium is screenprinted thereon. After drying and burning, exposed part of electrode pads 323 is formed.

After that, black dielectric glass paste is screenprinted in a lattice. After drying and burning, black matrix 33 is formed.

The front plate and the back plate are arranged in a certain way so that first line electrode group 22 and third line electrode group 32 are perpendicular to each other. The two plates are kept in alignment. Low-melting point glass frit is applied to the external surface of the plates. After drying and burning, a panel is attached.

Lastly, an air release pipe is attached to the panel. After making a vacuum inside the panel, discharge gas is ejected.

If major functions are mainly arranged on the back panel as shown in FIG. 1, naturally, the production method of such a back panel is complicated. However, according to the PDP of the present embodiment, resistance is arranged on the front panel. As major functions are distributed to the front panel and the back panel, yield of the panel production becomes better than that of the PDP in FIG. 1

Driving Method of PDP

Figure 7:
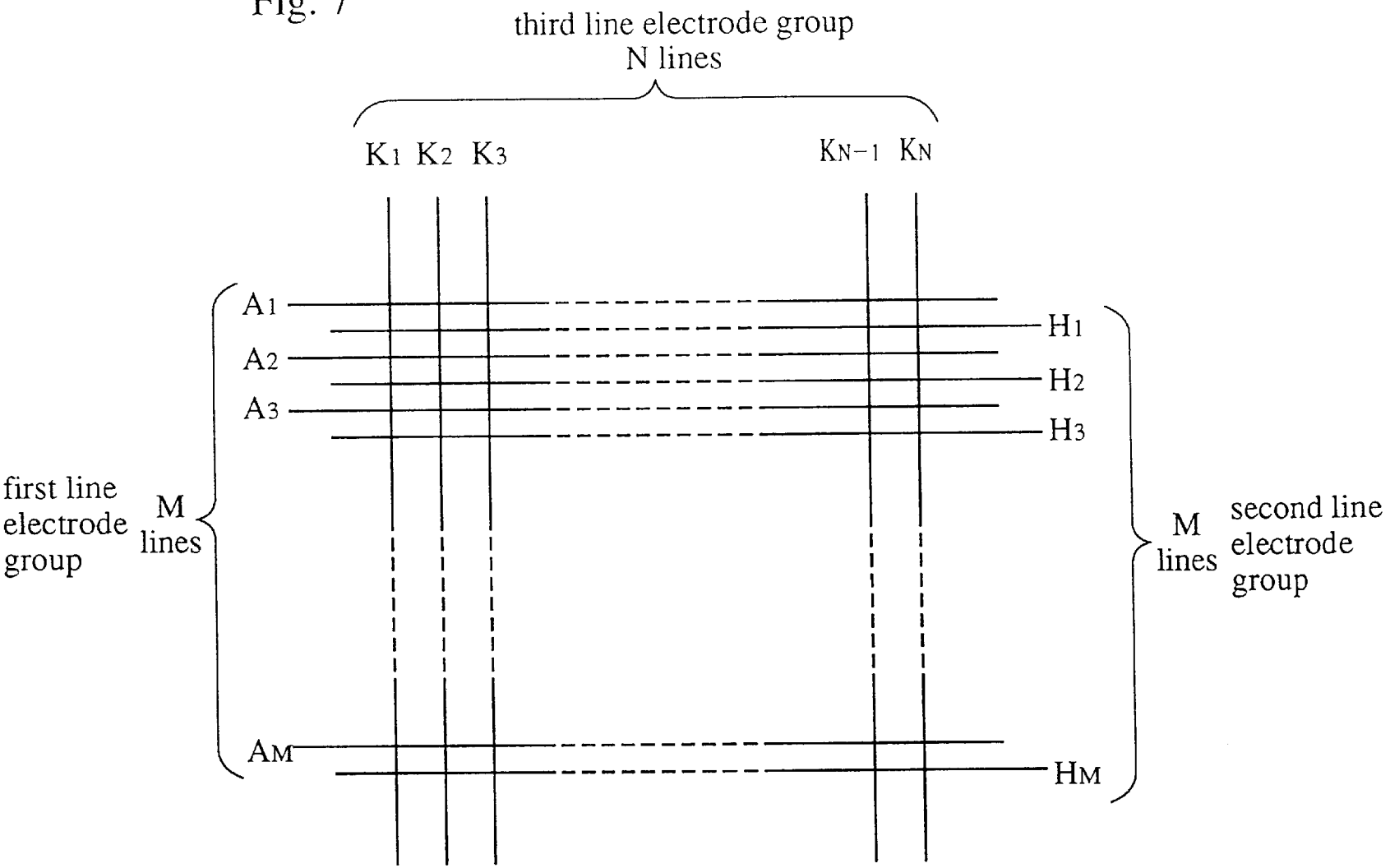
FIG. 7 shows a matrix layout circuit of the above mentioned PDP.
Figure 8:
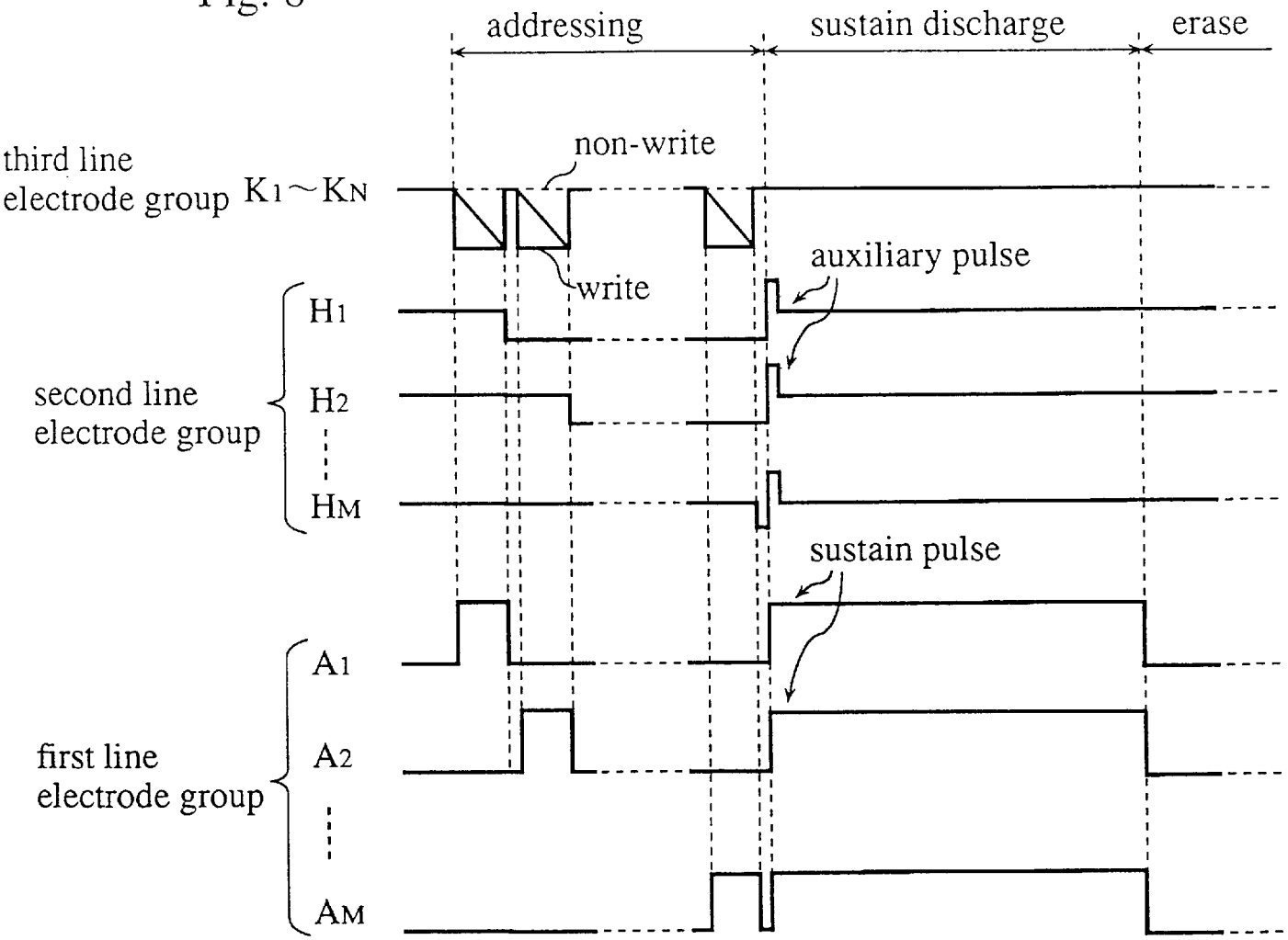
FIG. 8 is a time chart showing timing of applying pulses to each electrode in the above mentioned PDP.
Figure 9A:
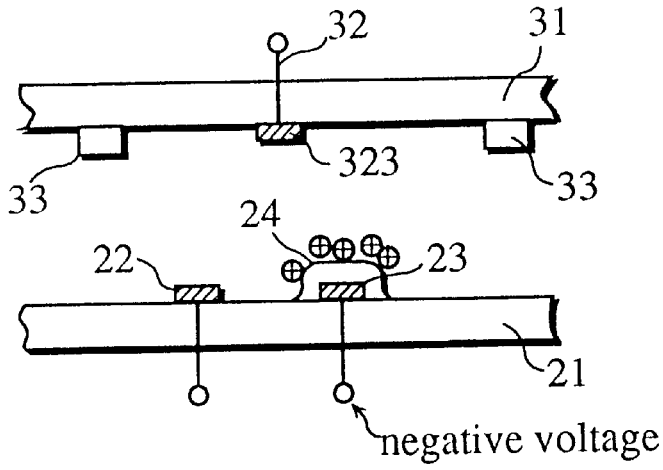
FIGS. 9A, 9B, and 9C are cross-sectional views showing operations of the discharge cell in the above mentioned PDP.
Figure 9B:
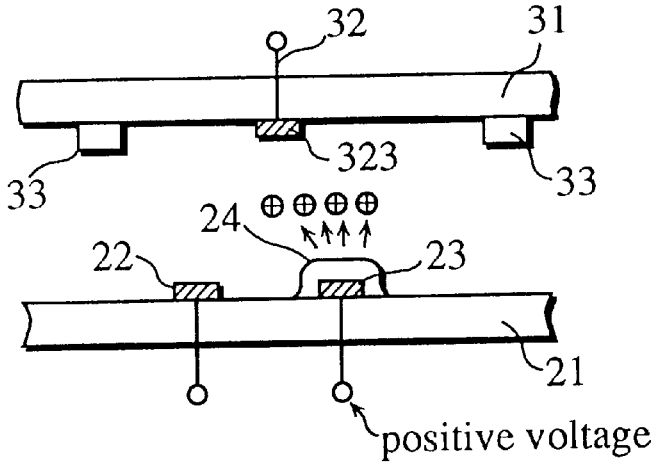
Figure 9C:
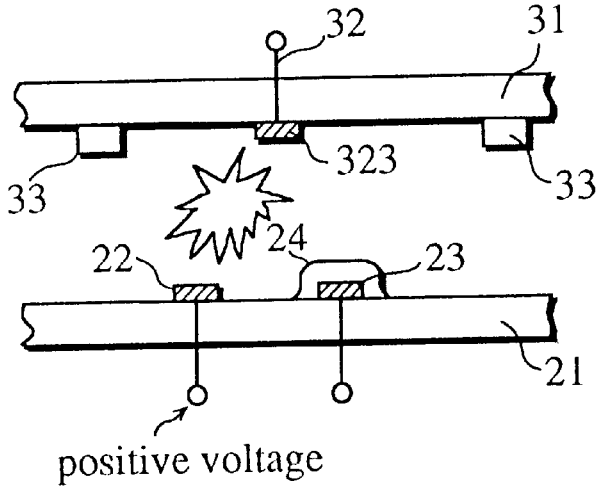

FIG. 7 shows a matrix layout circuit of the PDP of the present embodiment. FIG. 8 shows a time chart showing timing of applying pulses to each electrode. FIGS. 9A, 9B, and 9C are cross-sectional views showing operations of the discharge cell.

Driving method of the PDP of the present embodiment can be explained as follows by means of those figures.

The present driving method consists of; addressing operations of accumulating wall charges in a display cell for writing a screen of image information; and discharge sustaining operations of selectively sustaining discharge for the cell in which the wall charges are accumulated.

Addressing Operations

Addressing discharge is carried out by simultaneously applying a scan pulse of the positive voltage to the first line electrode $A_1$ in first line electrode group 22, and a write pulse of the negative voltage to electrodes corresponding to the display cell in third line electrode group 32 (line electrodes $K_1$–$K_N$). When the addressing discharge ends, by continuously applying the negative voltage below the discharge voltage to the first line electrode $H_1$ in second line electrode group 23, charges generated from the addressing discharge are accumulated on the surface of dielectric layer 24 as wall charges (FIG. 9A).

Next addressing discharge is carried out by simultaneously applying a scan pulse of the positive voltage to the second line electrode $A_2$ in first line electrode group 22, and a write pulse of the negative voltage to electrodes corresponding to the display cell in third line electrode group 32 (line electrodes $K_1$–$K_N$). When the addressing discharge ends, by continuously applying the negative voltage below the discharge voltage to the second line electrode $H_2$ in second line electrode group 23, charges generated from the addressing discharge are accumulated on the surface of dielectric layer 24 as wall charges.

Scanning by a series of the above mentioned operations, a screen of latent image is written.

As the series of addressing operations lasts for only a short period of time with weak discharge, there is no influence to the contrast.

If necessary, by carrying out initialization discharge for initializing the panel prior to the addressing operations, rise of the addressing discharge can be accelerated.

Discharge Sustaining Operations

Subsequent to the addressing operations mentioned above, discharge sustaining operations are carried out by adding a pulse to the entire panel at a time. Third line electrode group 32 (line electrodes $K_1$–$K_n$) is grounded, and an auxiliary pulse of the positive voltage having narrow width is applied to second line electrode group 23 (line electrodes $H_1$–$H_M$). Here, the voltage is lower than the discharge voltage. As a result, the wall charges are detached from the dielectric layer 24 and float in the discharge space (FIG. 9B).

By simultaneously applying a sustain pulse of the positive electrode to first line electrode group 22 ($A_1$–$A_M$), stable main discharge occurs between third line electrode group 32 and first line electrode group 22 in the cell having the floating charges (display cell), which is triggered by the priming effect. While the period in which the sustain pulse voltage is applied to third line electrode group 32, the main discharge is sustained in the display cell. Therefore, the emission continues.

The next explanation is about displaying TV images by the PDP of the present embodiment.

Red (R), green (G), and blue (B) are shown by the field time sharing graduation display method as explained in the conventional example.

Figure 10:
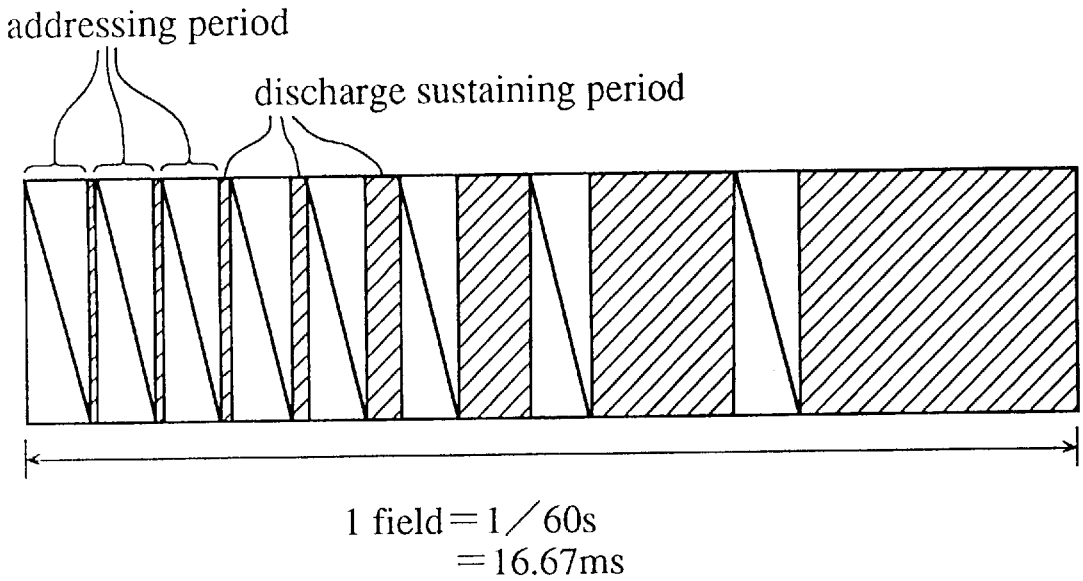
FIG. 10 is a graph showing a field dividing method for displaying 256 gray scales by the above mentioned PDP.

FIG. 10 is a graph showing a field dividing method for displaying 256 gray scales. The horizontal axis shows time, and the vertical axis shows order of the scanning line (scans from top to bottom). The hatched areas show discharge sustaining period.

One field is composed of eight sub-fields. Each sub-field is composed of an addressing period for a screen of image and a subsequent discharge sustaining period. The ratio of discharge sustaining period of each sub-field is set as 1/128, 1/64, 1/32, 1/16, 1/8, 1/4, 1/2, and 1, respectively. Combining the eight bit binary, 256 gray scales can be displayed.

With the write time for a scanning being 2 μsec (time needed for discharging), the write time for the addressing for a screen of image can be obtained by the following equation: for a sub-field, 2(μsec)*512(the number of TV scanning line)=1.02(msec); for one field, 1.02(msec)*8=8.16(msec).

Therefore, the discharge sustaining period within one field is 16.67−8.16=8.51(msec). The real discharge sustaining period which contributes to the emission is equal to this.

This real discharge sustaining period is about 5.6 times of the conventional real discharge sustaining period 1.53 (msec) shown in FIG. 4.

Therefore, in order to obtain the same luminosity as the conventional DC-PDPs, the discharge current which is necessary for sustaining operations is 0.18 times the current which is conventionally used. Moreover, by reducing the discharge current, luminous efficiency and panel life can be improved. It was found out from the experiment on the relationship between discharge current and luminous efficiency of the PDPs that luminous efficiency doubles by reducing the discharge current to 0.18 times the current which is conventionally used.

The discharge current and panel luminosity of the PDPs of the present embodiment and those of the conventional PDP are compared in an experiment. It was found out that in the case of the PDP of the present embodiment the discharge current necessary for obtaining the same luminosity as the CRT (about 500 cd/$m^2$) can be about 0.6 times the current which is conventionally used.

It is a known fact that a panel life (luminosity halving time) is in inverse proportion to square or cube of the discharge current. Therefore, in the case of the PDP of the present embodiment, by reducing the discharge current to 0.6 times the current which is conventionally used, it is possible to triple the panel life.

The conventional DC-PDPs require 765 sustain pulses for one field. On the other hand, the PDP of the present embodiment requires only eight pulses, so the electric losses due to the capacity load of the panel when turning ON and OFF the voltage of the sustain pulse can be suppressed to about 1% (8/765) of the conventional example.

Next, reactive power consumed in the discharge sustaining period of the PDP of the present embodiment and the same of the conventional AC-PDPs are compared. Here, the capacity of each panel is about the same.

In the case of the PDP of the present embodiment, the number of charging and discharging for applying the sustain pulse is per second is 8(sub-field)*2(ON, OFF)*60(field)=960 times.

In the case of the AC-PDP, the addressing period in one sub-field is 1.5 msec, and the discharge sustaining period in one field is 16.67−1.5*8=4.67 msec. Therefore, the charging and discharging number of applying the sustain pulse per second is 2(charging/discharging)*2(inversion)*100(kHz)*(4.67/16.67)=$1.1*10^5$.

Therefore, the ratio of charging/discharging number of both panels is 960/($1.11*10^5$)=0.009

Here, even if the recovery efficiency of the reactive power for motion-picture display by the conventional AC-PDP is 90%, the PDP of the present embodiment makes it possible to suppress 5 the consumption of the reactive power to about 9% of the same of the conventional AC-PDPs.

Table 1 shows comparison between the PDP of the present embodiment and the conventional PDP for their pixel size and emission characteristics, and the like.

TABLE 1

| | conventional example | Embodiment 1 |
|---|---|---|
| pixel size ($mm^2$) | 1.30 × 1.30 | 0.66 × 0.66 |
| luminosity (cd/$m^2$) | 150 | 500 |
| contrast ratio | 150:1 | 150:1 |
| luminous efficiency (1 m/W) | 0.4 | 0.6 |
| luminosity halving time (h) | 10000 | 30000 |
| luminescent spot incidence (%) | 0.0002 | 0.0001 |
| non-luminescent spot incidence (%) | 0.002 | 0.0006 |

As is apparent from Table 1, the PDP of the present embodiment only needs pixels, the size being 1/3 of the pixel which is conventionally used, and has luminosity and life that are three times the luminosity and life of the conventional PDPs.

Auxiliary Pulse and Sustain Pulse for Discharge Sustaining

The following explanation is about the auxiliary pulse to second line electrode group 23 and the sustain pulse to first line electrode group 22 during discharge sustaining operations.

In FIG. 8, the auxiliary pulse and the sustain pulse are rectangular. When the auxiliary pulse for second line electrode group 23 rises, the sustain pulse for first line electrode group 22 also rises. However, in order to use the wall charges for the discharge sustaining more surely or save the driving electricity, the following patterns are preferred.

Figure 11A:
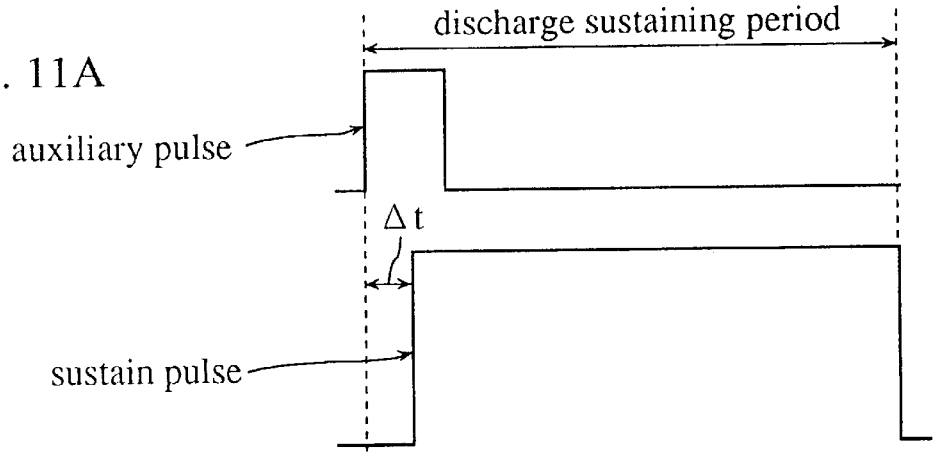
FIGS. 11A, 11B, and 11C shows the auxiliary pulses and sustain pulse to be applied during discharge sustaining operations in the above mentioned PDP.

① As shown in FIG. 11A, the sustain pulse to first line electrode group 22 rises just a little after the auxiliary pulse to second line electrode group 23 rises (time delay Δt).

In time delay Δt, the charges are detached from the dielectric layer by the auxiliary pulse without the influence of the sustain pulse. In other words, as the auxiliary pulse is not influenced by the sustain pulse, the wall charges can be used for the discharge sustaining for sure.

The desirable time delay Δt ranges from 0.01 to 5 μsec. Especially, the most preferable range is from 0.1 to 1 μsec. The reason can be explained as follows.

It is generally known that delay happens by the time which is (the moment the discharge is started)–(the moment a voltage above the discharge start voltage is applied to the discharge space). Even under the same conditions, this discharge delay time $T_d$ is not constant.

Discharge delay time $T_d$ consists of:constant delay time $T_1$ for the formation of the charged particles in the discharge space; and stochastic delay time $T_2$. $T_1$ depends on the discharge conditions such as discharge gas, discharge gap, and the like. Specifically, the lower the gas pressure and narrower the discharge gap and higher the applied voltage is, the less $T_1$ is. Under the discharge condition normally used for the PDP, such as the gas pressure of 100–600Torr, discharge gap of 50–300 μm, and the applied voltage of 100–500V, $T_1$ is 0.01–5 μsec.

Figure 11B:
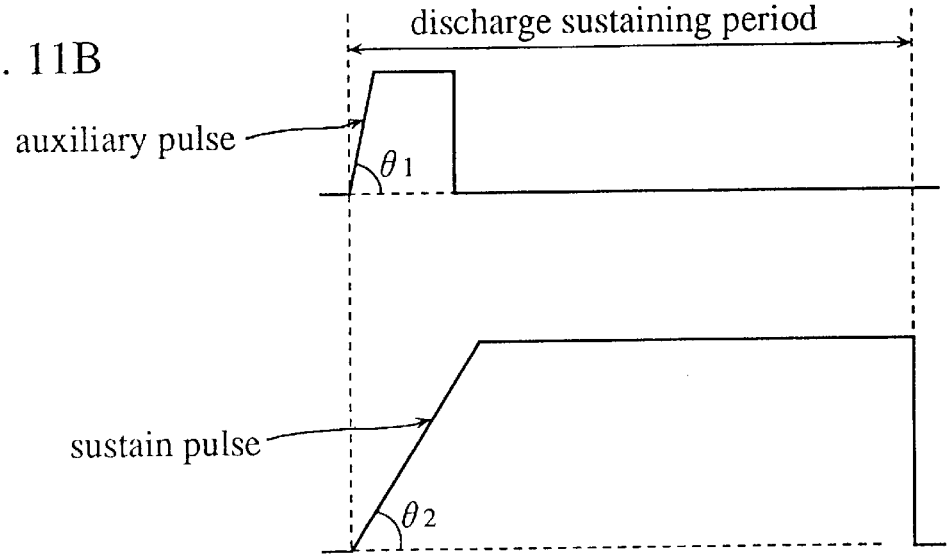

② As shown in FIG. 11B, the auxiliary pulse to second line electrode group 23 and the sustain pulse to first line electrode group 22 rise gradually (lamp pulse or step pulse), and slope $\theta_2$ of the sustain pulse is smaller than slope $\theta_1$ of the auxiliary pulse.

By gradually rising the auxiliary pulse and the sustain pulse, it is possible to suppress the self-erasing discharge which occurs during the pulse rise time.

Moreover, as the sustain pulse rises more slowly, the wall charges can be detached from the dielectric layer by the auxiliary pulse, not being so much influenced by the sustain pulse. Therefore, the wall charges can be used for the sustaining of the discharge for sure.

Figure 11C:
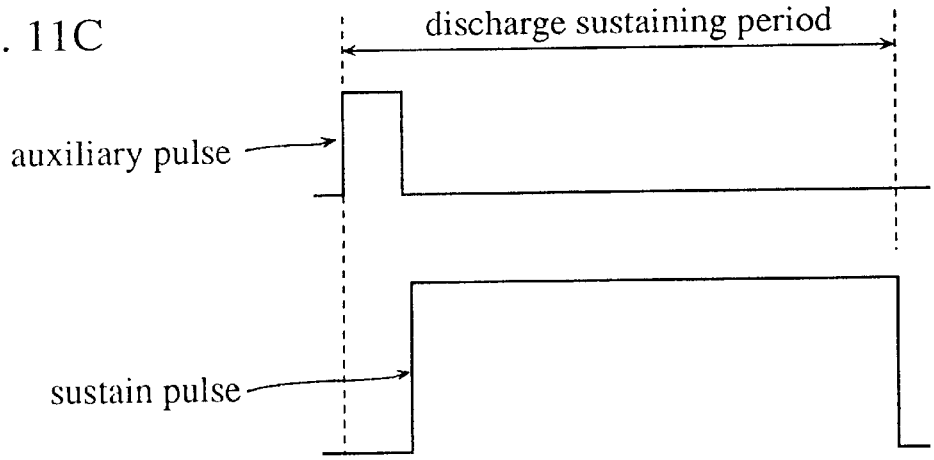

③ As shown in FIG. 11C, the sustain pulse to first line electrode group 2 rises after the auxiliary pulse decays.

In this case, in addition to the effect of ①, as the auxiliary pulse and the sustain pulse are not applied at the same time, the burden to the driving circuit can be reduced, and a driving circuit having small capacity can be used.

Figure 12A:
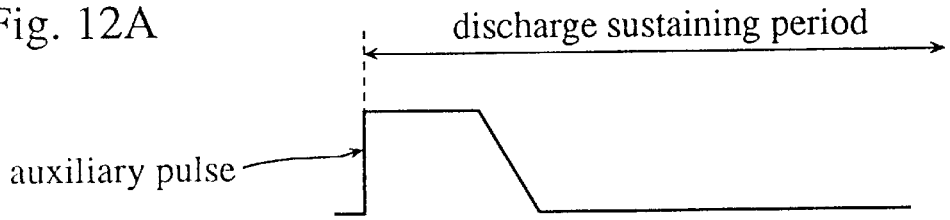
FIGS. 12A and 12B shows auxiliary pulses applied during discharge sustaining operations.
Figure 12B:
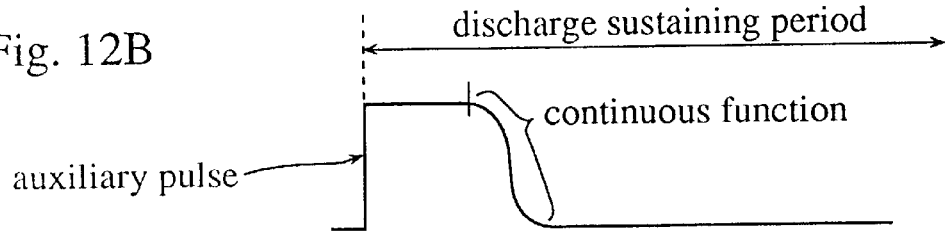

④ The auxiliary pulse to second line electrode group 23 decays gradually (lamp pulse of step pulse), as shown in FIG. 12A or the pulse decays like a continuous function. One of the concrete examples of the continuous function is cosine function. It can be readily realized to decay the auxiliary pulse like cosine function by using the driving circuit equipped with a resonance circuit.

By gradually decaying the auxiliary pulse, it is possible to suppress the self-erasing discharge which occurs during the pulse decay time.

Figure 13A:
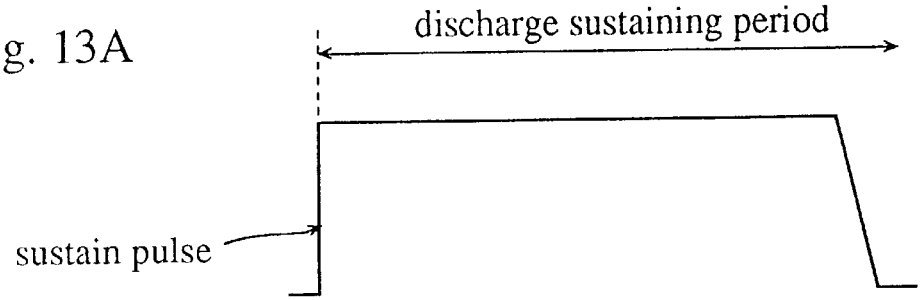
FIGS. 13A and 13B shows sustain pulse applied during discharge sustaining operations.
Figure 13B:
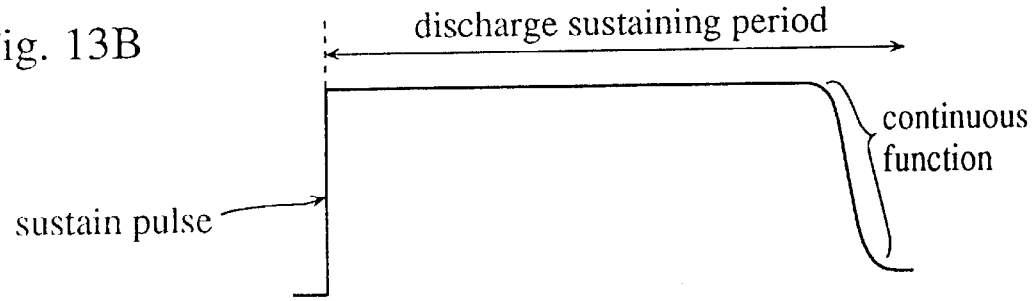

⑤ The sustain pulse to first line electrode group 22 decays gradually (lamp pulse or step pulse) as shown in FIG. 13A, or the pulse decays gradually like the cosine function as shown in FIG. 13B.

By gradually decaying the sustain pulse, it is possible to suppress the self-erasing discharge which occurs during the pulse decay time.

While the present embodiment, as herein disclosed, constitute a preferred form, it is to be understood that other forms might be adopted.

Positive voltage can be applied to the third line electrode group and negative pulse voltage can be applied to the first line electrode group.

Partitions can be arranged parallel to the first line electrode group. For addressing discharge, the scan pulse can be applied to the third line electrode group, and the write pulse can be applied to the first line electrode group.

The first line electrode group can be perpendicular to the second line electrode group on the back plate, and the third line electrode group arranged on the front plate can pass over the first line electrode group at right angles, with the first line electrode group being parallel to the partitions. For addressing discharge, the scan pulse can be applied to the third line electrode group and the write pulse can be applied to the first line electrode group.

The first line electrode group can be perpendicular to the second electrode group on the back plate, and the third line electrode group arrange on the front plate can pass over the first line electrode group at right angles, with the first line electrode group being perpendicular to the partitions. For addressing discharge, the scan pulse can be applied to the first line electrode group and the write pulse can be applied to the third line electrode group.

(Embodiment 2)

The PDP of the present embodiment has the same panel structure as the first embodiment, but differs in addressing operations.

Figure 14:
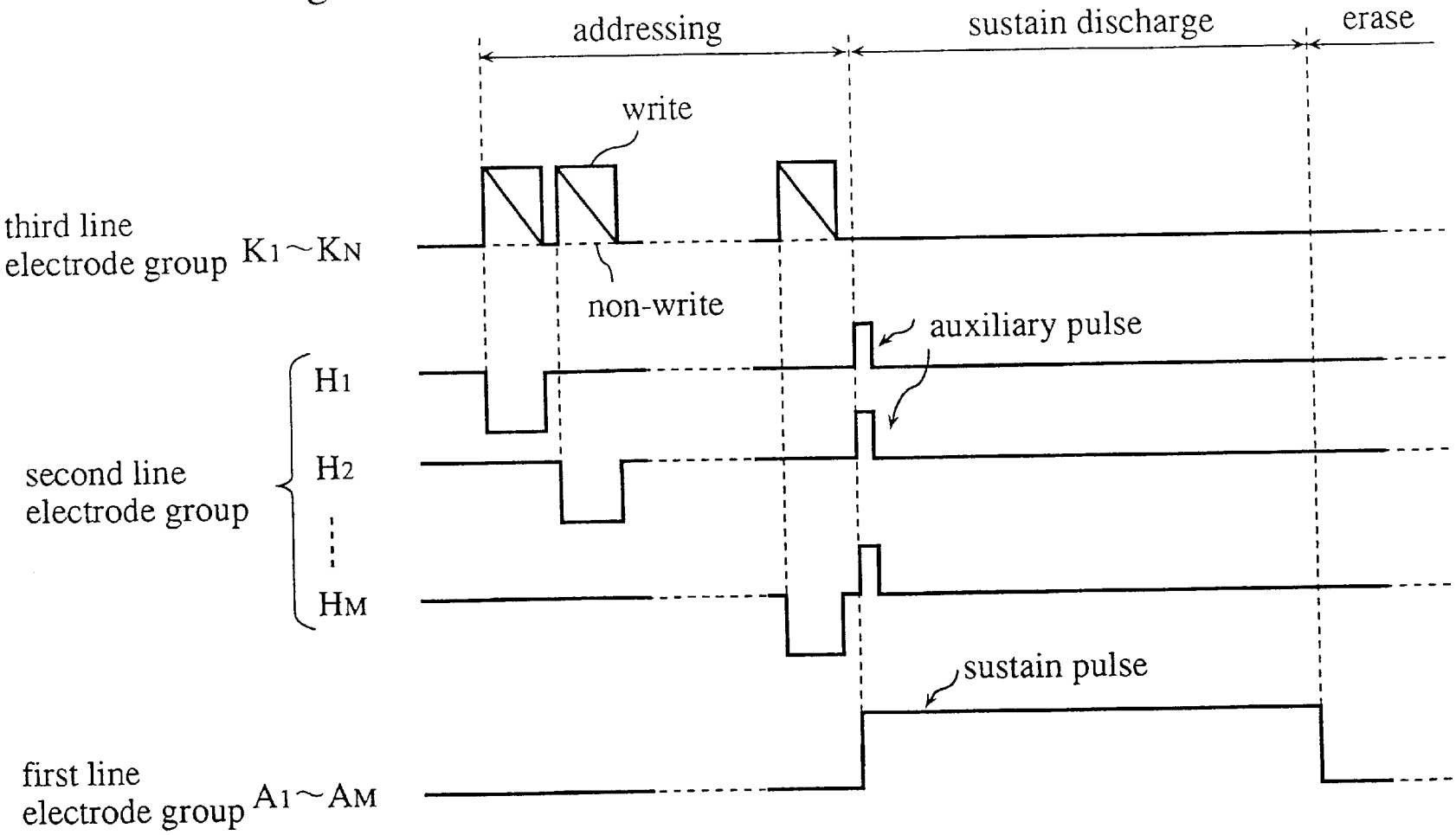
FIG. 14 is a time chart showing timing of applying pulses to each electrode in the PDP of the second embodiment.

The driving method of the present embodiment can be explained as follows by means of FIG. 14.

Wall charges are accumulated on the surface of the dielectric layer by the addressing discharge, which is carried out by simultaneously applying a scan pulse of the negative voltage to the first line electrode $H_1$ in second line electrode group 23, and a write pulse of the positive voltage to electrodes corresponding to the display cell in third line electrode group 32 (line electrodes $K_1$–$K_N$).

Next, wall charges are accumulated on the surface of the dielectric layer by the addressing discharge, which is carried out by simultaneously applying a scan pulse of the negative voltage to the second line electrode $H_2$ in second line electrode group 23, and a write pulse of the positive voltage to electrodes corresponding to the display cell in third line electrode group 32 (line electrodes $K_1$–$K_N$).

Scanning by a series of the above mentioned operations, a screen of latent image is written. If necessary, prior to the series of addressing operations, an initialization discharge for initializing the panel can be carried out.

Subsequent to the addressing operations, discharge sustaining operations are carried out so as to sustain the main discharge in the discharge cell.

The following explanation is about the driving operations of the PDP mentioned above used as a computer display.

As explained in the first embodiment, graduations are displayed by the field timesharing graduation display method.

In order to reduce eyestrain, non-interlace flicker free mode by sequential scanning is needed for a computer display. Therefore, refresh sheet has to be more than $70H_z$, and more than 70 fields per second should be displayed.

Figure 15:
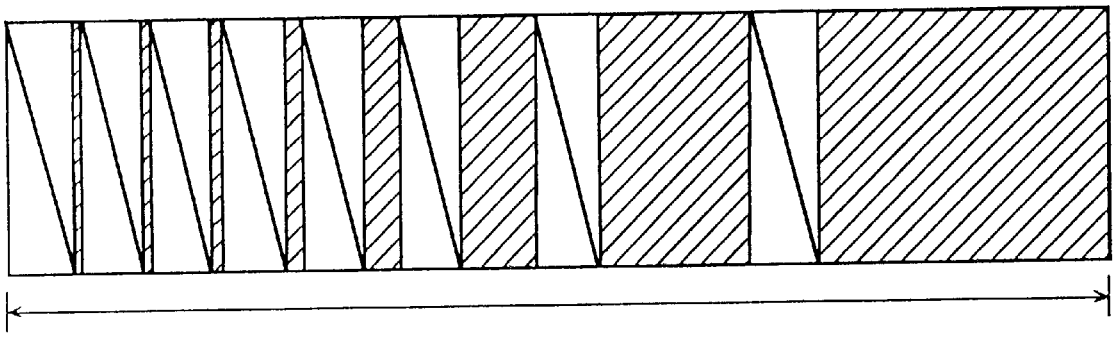
FIG. 15 is a graph showing the field dividing method for displaying 256 gray scales by the PDP of the second embodiment.

FIG. 15 is a graph showing the field dividing method for displaying 256 gray scales. It is the same graph as FIG. 10 for Embodiment 1, and refresh sheet is $72H_Z$ and one field is 13.89(msec).

With the write period for a scanning being 2 μsec, the write time for the addressing for a screen of image can be obtained by the following equation: for a sub-field, 2(μsec) *480 (VGA scanning line number)=0.96(msec); and for one field, 0.96(msec)*8=7.68(msec).

Therefore, the real discharge sustaining period that contributes to emission in one second is (13.89–7.68)*72=447.12(msec). This value is about 4.9 times the discharge sustaining period that contributes to the emission in one second in FIG. 4, which is 1.53*60=91.8 (msec). Therefore, luminosity and luminous efficiency can be improved.

Table 2 shows comparison between the PDP of the present embodiment and the conventional PDP for their pixel size and emission characteristics, and the like.

TABLE 2

| | conventional example | Embodiment 2 |
|---|---|---|
| pixel size ($mm^2$) | 1.30 × 1.30 | 0.66 × 0.66 |
| luminosity ($cd/m^2$) | 150 | 250 |
| contrast ratio | 150:1 | 250:1 |
| luminous efficiency (1 m/W) | 0.4 | 0.5 |

As is apparent from Table 2, the PDP of the present embodiment only needs pixels, the size being ⅓ of the pixel which is conventionally used, and has high luminosity and life.

For a computer display, the contrast ratio is more important than the luminosity.

Therefore, the luminosity, the contrast ratio, and the panel life can be improved, by reducing the discharge current to 0.6 times the current which is conventionally used and setting an extinction filter having transmittivity of 60% in front of the panel.

As mentioned above, the PDP of the present embodiment can display still pictures without flickering.

The addressing discharge of the first embodiment (between first line electrode group 22 and third line electrode group 32) requires lower driving voltage than the addressing discharge of the present embodiment (between second line electrode group 23 and third line electrode group 32).

This can be explained by comparing discharge cell A having two electrodes exposed to the discharge space, and discharge cell B having one electrode exposed to the discharge space and one electrode covered with dielectric. Both cells have the same gas pressure P, discharge gap d, form of the electrode, and electric field strength E.

As for discharge cell A, discharge start voltage $V_1$ can be expressed as $V_1=dE$.

As for discharge cell B, discharge start voltage $V_2$ can be expressed as $V_2=dE+d'E/\epsilon$, with d' being the thickness of the dielectric, and $\epsilon$ being ratio of the dielectric constant of the dielectric to the discharge gas.

As $V_2>V_1$, the discharge voltage of discharge cell A is lower than discharge cell 2.

(Embodiment 3)

The panel construction and driving method of the PDP of the present embodiment are the same as those of the second embodiment, except for applying negative voltage below the discharge voltage to second line electrode group 23 after the addressing discharge ends.

Figure 16:
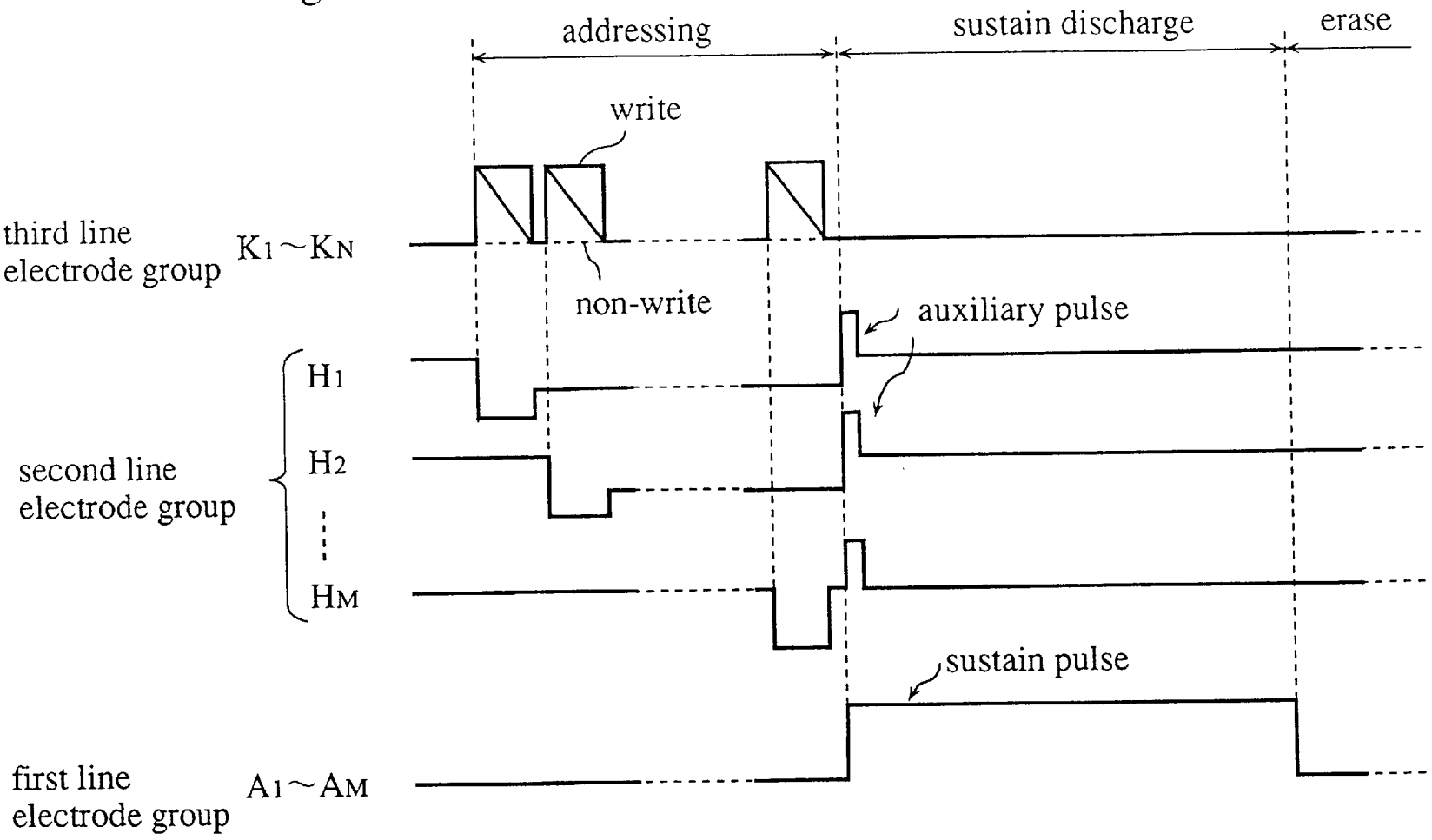
FIG. 16 is a time chart showing timing of applying pulses to each electrode in the PDP of the third embodiment.

The driving method of the PDP of the present embodiment can be explained as follows by means of FIG. 16.

Addressing discharge is carried out by simultaneously applying a scan pulse of the negative voltage to the first line electrode $H_1$ in second line electrode group 23, and a write pulse of the positive voltage to electrodes corresponding to the display cell in third line electrode group 32 (line electrodes $K_1$–$K_N$). When the addressing discharge ends, by continuously applying the negative voltage below the discharge voltage to line electrode $H_1$, charges generated from the discharge are accumulated on the surface of the dielectric layer as wall charges.

Next addressing discharge is carried out by simultaneously applying a scan pulse of the negative voltage to the second line electrode $H_2$ in second line electrode group 23, and a write pulse of the positive voltage to electrodes corresponding to the display cell in third line electrode group 32 (line electrodes $K_1$–$K_N$). When the addressing discharge ends, by continuously applying the negative voltage below the discharge voltage to the second line electrode $H_2$, charge generated from the addressing discharge are accumulated on the surface of the dielectric layer as wall charges.

Scanning by a series of the above mentioned operations, a screen of latent image is written. If necessary, prior to the series of addressing operations, an initialization discharge for initializing the panel can be carried out.

Subsequent to the addressing operations, discharge sustaining operations are carried out so as to sustain the main discharge in the discharge cell.

As mentioned above, by applying the negative voltage below the discharge voltage to second line electrode group 23 when the addressing discharge ends, much wall charges can be accumulated on dielectric layer 24 compared to the first embodiment. Therefore, it is possible to lit up a desired cell for sure, and the voltage of the auxiliary pulse applied during the discharge sustaining operations can be suppressed.

As explained in the first embodiment, graduations are displayed by the field timesharing graduation display method.

Table 3 shows comparison of the PDP of the present embodiment and the conventional PDP for their pixel size, emission characteristics, and the like.

TABLE 3

| | conventional example | Embodiment 3 |
|---|---|---|
| pixel size ($mm^2$) | 1.30 × 1.30 | 0.66 × 0.66 |
| luminosity ($cd/m^2$) | 150 | 500 |
| contrast ratio | 150:1 | 150:1 |
| luminous efficiency (1 m/W) | 0.4 | 0.6 |

As is apparent from Table 3, the PDP of the present embodiment only needs a pixel size, which is ⅓ of the pixel size conventionally used, and luminosity and life that are three times the luminosity and life of the conventional PDPs.

While the second and third embodiments, as herein disclosed, constitute a preferred form, it is to be understood that other forms might be adopted.

Positive pulse voltage can be applied to the second line electrode group and negative pulse voltage can be applied to the third line electrode group.

Partitions can be arranged parallel to the first line electrode group, and for addressing discharge, the scan pulse can be applied to the third line electrode group, and the write pulse can be applied to the first line electrode group.

The first line electrode group can be perpendicular to the second electrode group on the back plate, and the third line electrode group arranged on the front plate is parallel to the first line electrode group, with the partitions being perpendicular to the first line electrode group. For addressing discharge, the scan pulse can be applied to the third line electrode group and the write pulse can be applied to the second line electrode group.

The first line electrode group can be perpendicular to the second electrode group on the back plate, and the third line electrode group arranged on the front plate is parallel to the first line electrode group, with partitions and the third line electrode group being parallel to the first line electrode group. For addressing discharge, the scan pulse can be applied to the second line electrode group and the write pulse can be applied to the third line electrode group.

(Embodiment 4)

The PDP of the present embodiment has the same panel structure as that of the first embodiment, except that the second line electrode group is perpendicular to the first line electrode group on the back plate, and the third line electrode group on the front plate is parallel to the first electrode group.

Figure 17:
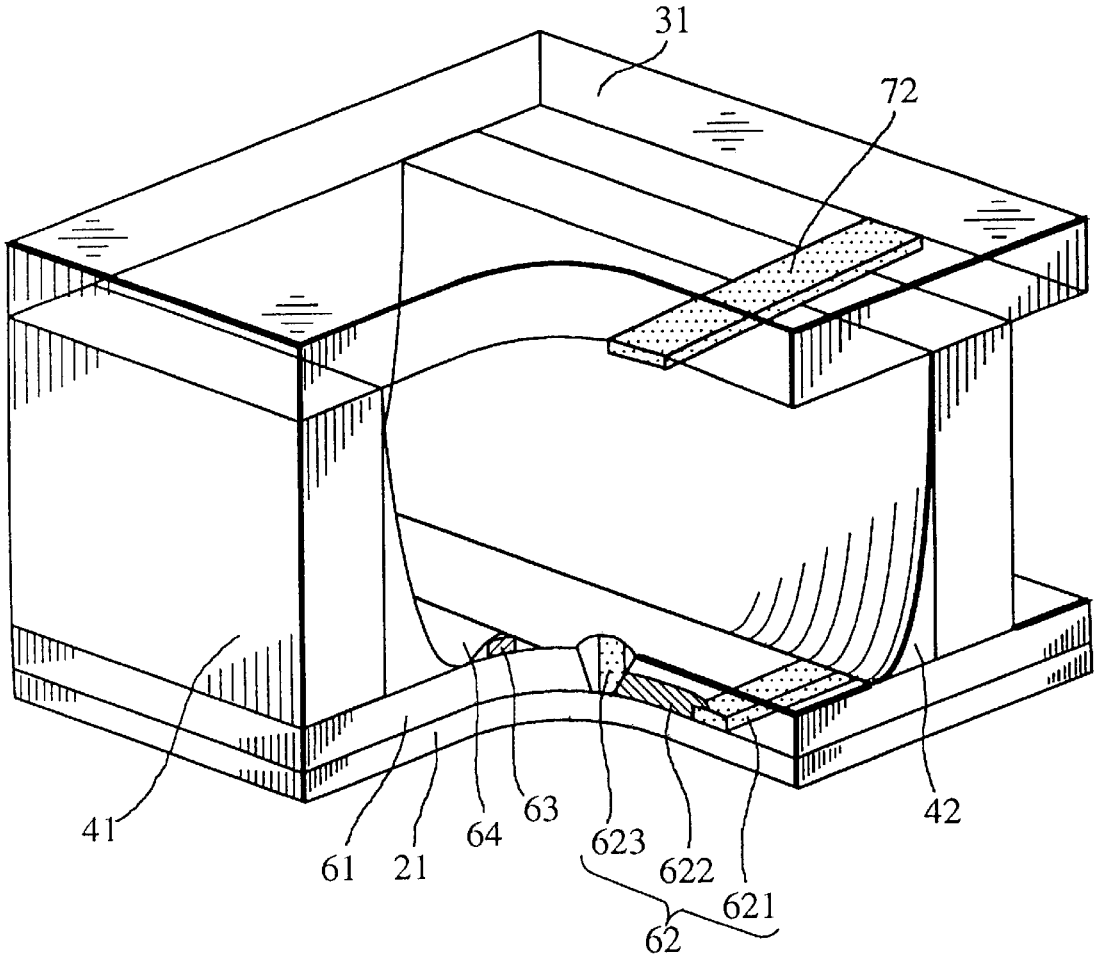
FIG. 17 is a perspective side view of the panel structure of the PDP of the fourth embodiment.

FIG. 17 is a perspective side view of the panel structure of the PDP of the present embodiment, focusing on a cell.

Glass substrate 21 and glass substrate 31 are arranged in parallel via parallel partitions 41.

On the internal surface of glass substrate 21 , all electrodes in first line electrode group 62 are arranged in parallel and insulator layer 61 is deposited thereon. On insulator layer 61, second line electrode group 63 is arranged perpendicular to first line electrode group 62, with all electrodes in second line electrode group 63 being arranged in parallel. Each electrode in second line electrode group is covered with dielectric layer 64.

On the insulator layer 61, partitions 41 are arranged perpendicular to first line electrode group 62. Insulator layer 61, glass substrate 31, and partitions 41 form discharge spaces. Discharge gas (mixture of helium and xenon) is filled in each discharge space. In each space, phosphor layer 42 is arranged on partitions 41 and insulator layer 61, with dielectric layer 64 being exposed to the discharge space.

First line electrode group 62 consists of parallel bus bars 621, resistance 622 branches off bus bars 621, and electrode pads 623 that pass through insulator layer 61 and being exposed to the discharge space.

On the internal surface of glass substrate 31, third line electrode group 72 is arrange parallel to first line electrode group 62. In third line electrode group 72, all electrodes are arranged in parallel.

Figure 18:
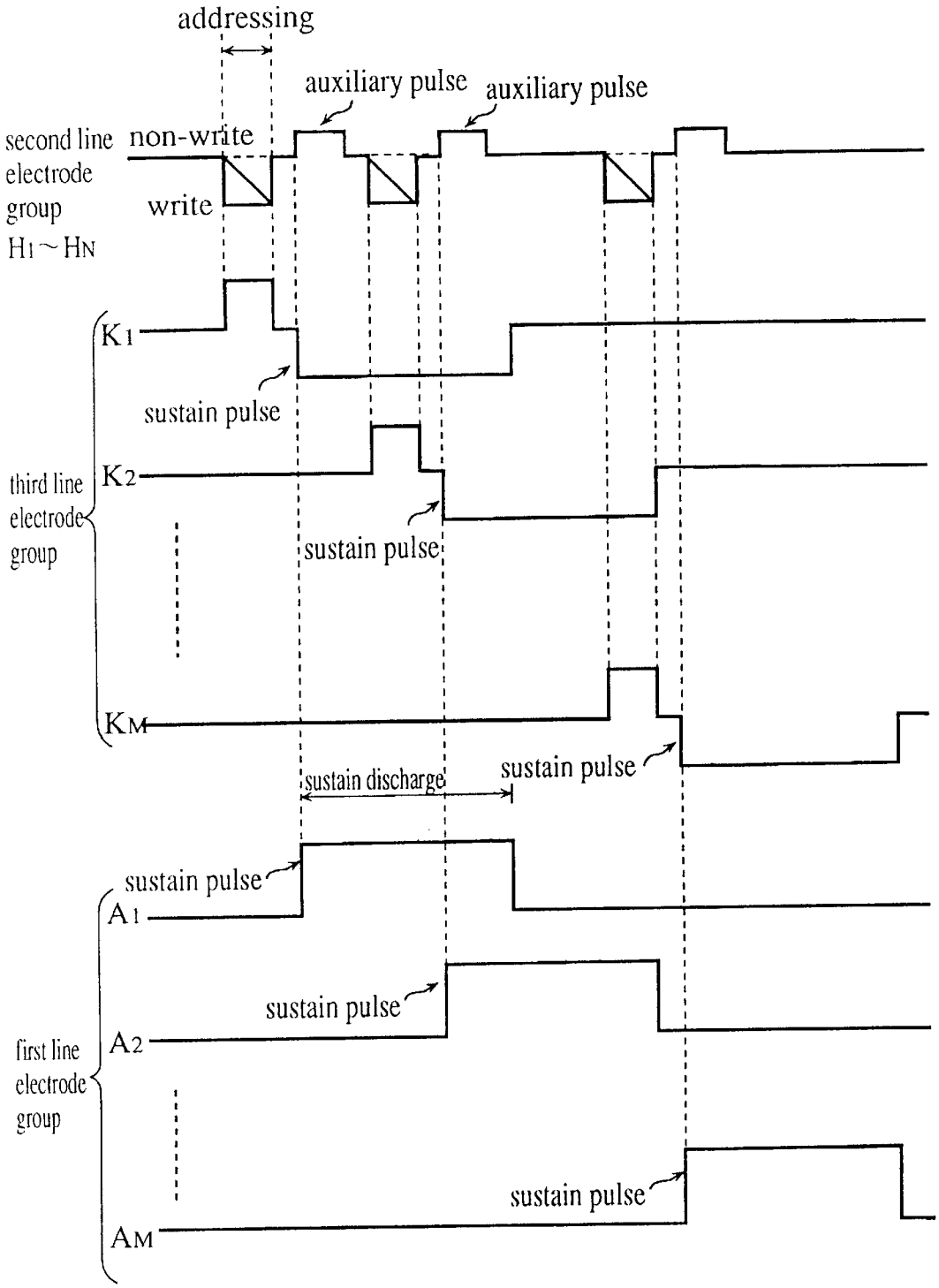
FIG. 18 is a time chart showing timing of applying pulses to each electrode in the PDP of the fourth embodiment.

FIG. 18 is a time chart showing timing of applying pulses to each electrode. The driving method of the PDP of the present embodiment can be explained as follows by means of this figure.

According to the present embodiment, as third line electrode group 72 and first line electrode group 62 are arranged in parallel, it is possible to sustain discharging for each scanning line.

Therefore, it is possible to make the ratio of the discharge sustaining period in one field greater by starting discharge sustaining for each scanning line as will be apparent from the following explanation.

Wall charges are accumulated on the surface of the dielectric layer by the addressing discharge, which is carried out by simultaneously applying a scan pulse of the positive electrode to first line electrode $K_1$ in third line electrode group 72, and a write pulse of the negative voltage to electrodes corresponding to the display cell in second line electrode group 63 (line electrodes $H_1$–$H_N$).

After that, an auxiliary pulse of the positive voltage having narrow width is applied to second line electrode group 63. Here, the applied voltage is lower than the discharge voltage. As a result, the wall charges are detached from the dielectric layer 64 and float in the discharge space.

Applying a sustain pulse of the negative voltage to line electrode $K_1$ and a sustain pulse of the positive electrode to line electrode $A_1$ in first line electrode group 62 at the same time, stable main discharge takes place between the line electrode $K_1$ and line electrode $A_1$ in the cell having the floating charges (display cell). This is triggered by the priming effect. During the period in which the sustaining pulse voltage is applied to both line electrodes, the main discharge is sustained in the display cell.

Wall charges are accumulated on the surface of the dielectric layer by the addressing discharge, which is carried out by simultaneously applying a scan pulse of the positive voltage to the second line electrode $K_2$ in third line electrode group 72, and a write pulse of the negative voltage to electrodes corresponding to the display cell in second line electrode group 63 (line electrodes $H_1$–$H_N$).

Next, by applying an auxiliary pulse of the positive voltage having narrow width to second line electrode group 63, wall charges are detached from the dielectric layer and float in the discharge space. After that, a negative sustain pulse is applied to line electrode $K_2$ and a positive sustaining pulse is applied to the second line electrode $A_2$ in first line electrode group 62 at the same time, thereby generating stable main discharge in-between. During the period in which the sustain pulse voltage is applied to both electrodes, the main discharge is sustained in the display cell.

Scanning by a series of the above mentioned operations, a screen of latent image is written and discharge sustaining operations are carried out.

Figure 19:
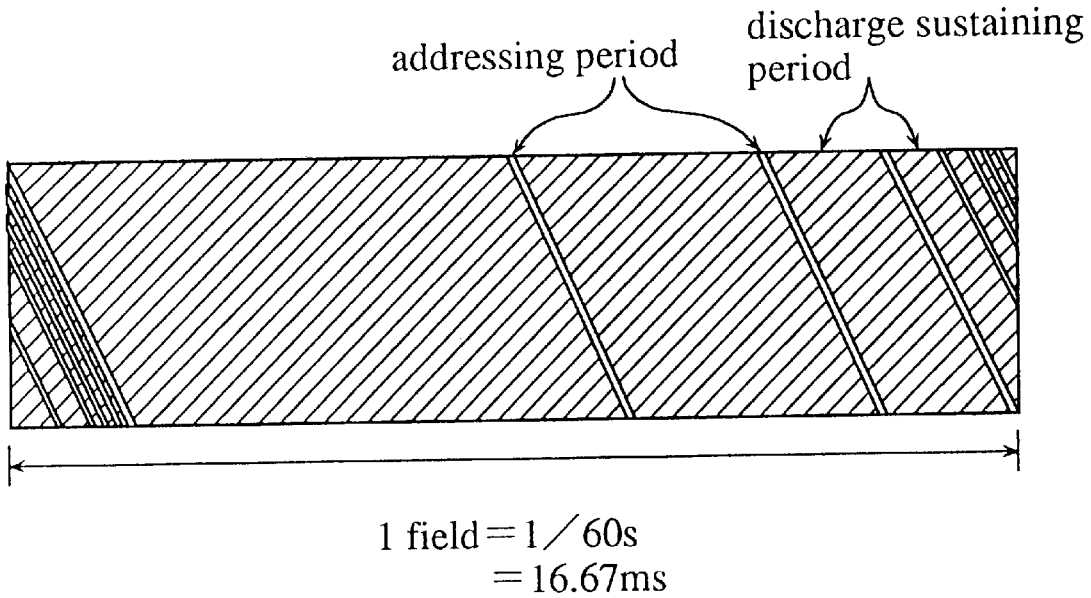
FIG. 19 is a graph showing the field dividing method for displaying 256 gray scales by the PDP of the fourth embodiment.

FIG. 19 is a graph showing the field dividing method for displaying 256 gray scales by the PDP of the present embodiment.

As is shown by the figure, one field consists of eight sub-fields. As the writing operation and the discharge sustaining operations are carried out for each scanning line, the ratio of the discharge sustaining period in one field has become even greater than the ratios in Embodiments 1–3.

In Embodiments 1–3, as the resistance was embedded in the third line electrode group, electricity was consumed in the resistance during the addressing discharge; whereas in the present embodiment, as the resistance is not embedded in the second line electrode group nor the third line electrode group, electricity is not consumed in the resistance when the addressing discharge takes place. Therefore, electricity to be consumed can be saved, thereby improving driving efficiency.

(Others)

In the PDP of Embodiments 1–4, the first and the second line electrode groups, the bus bars and lower part of the electrode pads in the third line electrode group are made from silver. But this silver can be replaced by: metals such as gold, copper, chrome, nickel and platinum; or conductive metallic oxide such as $SnO_2$, ITO, and ZnO.

In Embodiments 1–4, the exposed part of the electrode pads are made of aluminium. But this aluminium can be replaced by perovskite conductive oxide such as $La_{1-x}Sr_xCoO_3$, $La_{1-x}Sr_xMnO_3$; or silver; or ruthenium oxide; or graphite.

In the PDP of Embodiments 1–4, while the dielectric layer is made of the low-melting point lead glass, the low-melting point lead glass can be replaced by low-melting point bismuth glass, or lamination layer of the low-melting point lead glass and the low-melting point bismuth glass.

Although the present invention has been fully described by way of examples with reference to the accompanying drawings, it is to be noted that various changes and modifications will be apparent to those skilled in the art. Therefore, unless otherwise such changes and modifications depart form the scope of the present invention, they should be construed as being included therein.

What is claimed is:

1. A driving method of a plasma-display panel comprising: a first insulator substrate and a second insulator substrate which is arranged at a given distance above the first insulator substance; the first insulator substrate having a first line electrode group and a second line electrode group, with the electrodes being arranged in parallel in each group, and the second insulator substrate having a third line electrode group which has parallel electrodes passing over at least one of the first line electrode group and the second line electrode group at right angles so that the third line electrode group and the selected line electrode group on the first insulator substrate appear to form a two-dimensional lattice when viewed from above; thereby forming a discharge space between the first insulator substrate and the second insulator substrate; the first line electrode group and the third line electrode group having parts exposed to the discharge space, while the second line electrode group being covered by dielectric layer in the discharge space; the method comprising the steps of:

addressing for writing image information by providing an addressing discharge between the exposed line electrode groups which appear to form a two-dimensional lattice when viewed from above and accumulating charges on the dielectric layer; and discharge sustaining after said addressing for detaching the charges from the dielectric layer so as to float them in the discharge space by applying an auxiliary pulse voltage below discharge voltage to the second electrode group, and generating a direct current discharge by applying a sustain pulse voltage in-between the first line electrode group and the third line electrode group.

2. The driving method of claim 1, wherein the discharge sustaining step rises the sustain pulse voltage after the rise of the auxiliary pulse voltage.

3. The driving method of claim 2, wherein time difference between the rise of the auxiliary pulse voltage and the rise of the sustain pulse voltage ranges from 0.01 to 5 m seconds.

4. The driving method of claim 3, wherein the time difference between start of rise of the auxiliary pulse voltage and start of rise of the sustain pulse voltage ranges from 0.1 to 1 m seconds.

5. The driving method of claim 1, wherein the discharge sustaining step makes a slope of the sustain pulse voltage smaller than the slope of the auxiliary pulse voltage.

6. The driving method of claim 1, wherein the discharge sustaining step rises the sustain pulse after decay of the auxiliary pulse.

7. The driving method of claim 1, wherein the auxiliary pulse voltage applied in the discharge sustaining step is one of decaying lamp pulse and a decaying step pulse.

8. The driving method of claim 7, wherein the auxiliary pulse voltage applied in the discharge sustaining step decays like continuous function.

9. The driving method of claim 1, wherein the sustain pulse voltage applied in the discharge sustaining step is one of the decaying lamp pulse and the decaying step pulse.

10. The driving method of claim 9, wherein the sustain pulse voltage applied in the discharge sustaining step decays like consecutive function.

11. A driving method of a plasma-display panel comprising, a first insulator substrate and a second insulator substrate which is arranged at a given distance above the first insulator substrate; the first insulator substrate having a first line electrode group and a second line electrode group, with the electrodes being arranged in parallel in each group, and the second insulator substrate having a third line electrode group which has parallel electrodes passing over the first line electrode group at right angles so that the third line electrode group and the first line electrode group appear to form a two-dimensional lattice when viewed from above; thereby forming a discharge space between the first insulator substrate and the second insulator substrate; the first line electrode group and the third line electrode group having parts exposed to the discharge space, while the second line electrode group being covered by a dielectric layer in the discharge space; the method comprising the steps of:

addressing for writing image information by providing an addressing discharge between the first electrode group and the third line electrode group and accumulating charges on the dielectric layer by applying a voltage below a discharge voltage to the second line electrode group; and discharge sustaining after said addressing for detaching the charges from the dielectric layer so as to float them in the discharge space by applying an auxiliary pulse voltage to the second electrode group, and generating a direct current discharge by applying a sustain pulse voltage in-between the first line electrode group and the third line electrode group.

12. A plasma-display panel comprising, a first insulator substrate and a second insulator substrate which is arranged at a given distance above the first insulator substance; the first insulator substrate having a first line electrode group and a second line electrode group, with the electrodes being arranged in parallel in each group, the second insulator substrate having a third line electrode group which has parallel electrodes passing over the second line electrode group at right angels so that the third electrode group and the second electrode group appear to form a two-dimensional lattice when viewed from above; thereby forming a discharge space between the first insulator substrate and the second insulator substrate; the first line electrode group and the third line electrode group having parts exposed to the discharge space, while the second line electrode group being covered by the dielectric layer in the discharge space;

wherein the first line electrode group has resistance between bus bar and the part exposed to the discharge space.

13. A plasma-display panel comprising; a first insulator substrate and a second insulator substrate which is arranged at a given distance above the first insulator substrate, the first insulator substrate having a first line electrode group and a second line electrode group, with the electrodes in each group being arranged perpendicular to each other, the second insulator substrate having a third line electrode group passing over the first line electrode group in parallel; thereby forming a discharge space with a wall between the first insulator substrate and the second insulator substrate; the first line electrode group and the third line electrode group having parts exposed to the discharge space, while the second line electrode group being covered by the dielectric layer in the discharge space; an addressing means for initially accumulating a charge on the wall and dielectric layer by scanning an addressing discharge between the third line electrode group and the second line electrode group; and a discharge means for generating a direct current discharge by applying a sustaining voltage between the first line electrode group exposed part and the third line electrode group exposed part for each scan line.

14. A DC plasma display panel for displaying color video signals with high definition image quality, comprising:

an array of discharge cells defined by separating walls, each cell containing material for producing a color emission of light; each cell includes an electrically addressable first electrode with an exposed portion within the cell, an electrically addressable second electrode covered with a dielectric layer within the cell and an electrically addressable third electrode with an exposed portion within the cell;

an addressing means for initially accumulating a charge on the cell walls and the dielectric layer by scanning an addressing discharge pulse between the second electrode and the third electrode; and a discharge means for generating a direct current discharge by applying a sustaining voltage between the first electrode exposed portion and the third electrode exposed portion.

15. The DC plasma display panel of claim 14, wherein a black matrix pattern separates the array of discharge cells.

16. The DC plasma display panel of claim 15, wherein a pixel size of corresponding discharge cells is approximately $0.66 \times 0.66$ $mm^2$.

17. The DC plasma display panel of claim 16, wherein the discharge means provides a luminosity of approximately 250 to 500 $Cd/m^2$.

18. The DC plasma display panel of claim 16, wherein the discharge means provides a luminous efficiency of approximately 0.5 to 0.6 lm/W.

19. The DC plasma display panel of claim 14, wherein the third electrode is connected to a resistance.

20. The DC plasma display panel of claim 14, wherein the addressing means applies a direct current pulse.

21. The DC plasma display panel of claim 14, further including a sustaining discharge means for applying an auxiliary pulse to the second electrode while applying a sustaining pulse to the first electrode.

22. The DC plasma display panel of claim 21, wherein a positive voltage is applied as the auxiliary pulse and the sustaining pulse.

23. The DC plasma display panel of claim 22, wherein the third electrode is grounded during the sustaining period.

24. The DC plasma display panel of claim 22, wherein the auxiliary pulse is only applied during an initial period of the sustaining pulse.

25. The DC plasma display panel of claim 21, wherein a pixel size of corresponding discharge cells is approximately $0.66 \times 0.66$ $mm^2$.

26. The DC plasma display panel of claim 25, wherein the discharge means provides a luminosity of approximately 250 to 500 $Cd/m^2$.

* * * * *